US005327157A

United States Patent [19]

Akiyama et al.

[11] Patent Number: 5,327,157

[45] Date of Patent: Jul. 5, 1994

[54] DISPLAY WITH ENHANCED SCROLLING CAPABILITIES

[75] Inventors: Alex A. Akiyama, Tokyo, Japan; Leah J. H. Busboom, Oronoco; William J. Maitland, Jr., Rochester, both of Minn.

[73] Assignee: International Business Machines Corporation, Armonk, N.Y.

[21] Appl. No.: 993,164

[22] Filed: Dec. 18, 1992

Related U.S. Application Data

[62] Division of Ser. No. 665,197, Mar. 1, 1991, Pat. No. 5,237,312, which is a division of Ser. No. 339,346, Apr. 17, 1989, Pat. No. 5,038,138.

[51] Int. Cl.[5] ..... G09G 1/06

[52] U.S. Cl. ..... 345/119; 345/115

[58] Field of Search ..... 340/724, 723, 726, 721, 340/709, 799; 345/119, 120, 118, 121, 123, 113, 115

[56] References Cited

U.S. PATENT DOCUMENTS 4,642,790 2/1987 Minshull et al. ..... 340/726

*Primary Examiner*—Alvin E. Oberley

*Assistant Examiner*—Xiao M. Wu

*Attorney, Agent, or Firm*—Curtis G. Rose; Steven W. Roth

[57] ABSTRACT

A computer display has a display processor connected to a presentation space buffer and a screen buffer. The presentation space buffer is larger than the screen buffer, and is divided into a plurality of partitions. Each partition has a partition window which maps into the screen buffer. If a partition is active, its associated partition window is written into the screen buffer at the mapped location. The screen buffer periodically refreshes the display screen, so a plurality of partition windows are displayed to the computer user. One or more scroll groups can be defined, and one or more partitions can be assigned to each scroll group. Each defined scroll group has a vertical scroll trigger and a horizontal scroll trigger. The display monitors the movement of the cursor within a partition window. When the cursor gets close enough to a boundary of a partition window, to trigger a scroll trigger, the display shifts the partition window within its partition and writes this updated partition window into the screen buffer. Updated partition windows are written into the screen buffer for the other partitions in the scroll group.

10 Claims, 21 Drawing Sheets

SCROLL GROUP DEFINITIONS

| | |
|---|---|
| Scroll Group 61: | Partitions 52, 53, 55<br>Vertical Scroll Trigger = 3<br>Horizontal Scroll Trigger = 5<br>Rows to Scroll = 10<br>Columns to Scroll = 15 |
| Scroll Group 63: | Partition 57<br>Vertical Scroll Trigger = 10<br>Horizontal Scroll Trigger = 10<br>Rows to Scroll = 20<br>Columns to Scroll = 20 |

FIG. 4

DISPLAY WITH ENHANCED SCROLLING CAPABILITIES

This is a divisional of co-pending U.S. patent application Ser. No. 07/665,197 filed on Mar. 1, 1991, now U.S. Pat. No. 5,237,312 which was a divisional of co-pending U.S. patent application Ser. No. 07/339,346 filed on Apr. 17, 1989, now U.S. Pat. No. 5,038,138.

FIELD OF THE INVENTION

This invention relates to the data processing field. More particularly, this invention is a display with enhanced scrolling capabilities.

BACKGROUND OF THE INVENTION

A computer system is comprised of many hardware and software components that work together to perform tasks requested of it by a computer user. Many of these components are never seen by a user, and most users don't know or care what function they perform. The computer display, however, is probably the most visible component of the computer system, as it is the usual interface between user and machine.

Although computer users may be tolerant of substandard performance in the computer components they don't see, they are far less tolerant of substandard performance in components they do see, such as the computer display. For example, when computer users work with a word processing program, they want to be able to enter text as quickly as they can type without having to wait for the display to catch up with them. Likewise, when they press a key on the keyboard, such as "enter", "page up" or "page down", they want the display to respond quickly and efficiently so they do not have to wait.

If they have to wait for the computer display to perform a seemingly simple task, like scrolling to the next page, they can become frustrated, and often take out their frustration by punching the keyboard (which can damage the keyboard) or punching the screen (which can damage the hand).

Although this problem exists in standalone "smart" displays, such as personal computers, this problem is exasperated if the computer display is a fixed function display connected to a workstation controller. Fixed function displays are often called "dumb" displays, since these displays merely display the data that is sent to them by the workstation controller, and have little if any smarts of their own. For example, every time the user of a fixed function terminal wants to scroll to a new page, the workstation controller must transmit the new page of data to the display. Since the workstation controller often controls several fixed function displays that are making simultaneous requests for new data, a particular computer user may have to wait for the workstation controller to service his fixed function display. This delay can be quite perceivable and annoying if the workstation controller is busy. Delays are also caused in transmission between the workstation controller and the display especially if the workstation controller is a long distance away from the display, or is remotely attached via telephone lines.

SUMMARY OF THE INVENTION

It is a principal object of the invention to have a computer display cable of responding to a user's requests quickly and efficiently.

It is another object of the invention to have a computer display with enhanced scrolling capabilities.

It is another object of the invention to send data from a workstation controller to a fixed function display in an efficient manner.

These and other objects are accomplished by the computer display with enhanced scrolling capabilities disclosed herein. A computer display has a display processor connected to a presentation space buffer and a screen buffer. The presentation space buffer is larger than the screen buffer, and is divided into a plurality of partitions. Each partition has a partition window which maps into the screen buffer. If a partition is active, its associated partition window is written into the screen buffer at the mapped location. The screen buffer periodically refreshes the display screen, so a plurality of partition windows are displayed to the computer user.

One or more scroll groups can be defined, and one or more partitions can be assigned to each scroll group. Each defined scroll group has a vertical scroll trigger and a horizontal scroll trigger. The display monitors the movement of the cursor within a partition window. When the cursor gets close enough to a boundary of a partition window to trigger a scroll trigger, the display shifts the partition window within its partition and writes this updated partition window into the screen buffer. Updated partition windows are written into the screen buffer for the other partitions in the scroll group.

Partitions can be either active or inactive. Partition windows from active partitions are mapped and written into the screen buffer, as discussed above. Partition windows from inactive partitions are mapped but not written into the screen buffer until the partition is activated. More than one partition window can be mapped into the same location in the screen buffer. When a previously inactive partition is activated, the partition window is written to the screensbuffer, possibly partially or completely overlaying other partition windows.

In the preferred embodiment, the computer display is an enhanced fixed function display connected to a workstation controller. In addition to the presentation space buffer and screen buffer, the display also has a command buffer for receiving commands from the workstation controller. These commands specify the parameters required to perform the above functions, and very little overhead from the workstation controller is required. Therefore, much of the workload of the workstation controller is done by the display, thereby resulting in increased function while improving performance and reducing response time. The workstation controller is not required to monitor the position of the cursor on the screen and send down a new screen of data every time the user wants to scroll. Instead, the workstation controller monitors the position of the cursor in the larger presentation space buffer and only needs to send new data to the display when the cursor is at or near the boundary of the presentation space buffer.

BRIEF DESCRIPTION OF THE DRAWING

FIG. 4 shows how scroll groups of the invention can be defined.

DESCRIPTION OF THE PREFERRED EMBODIMENT

Figure 1:
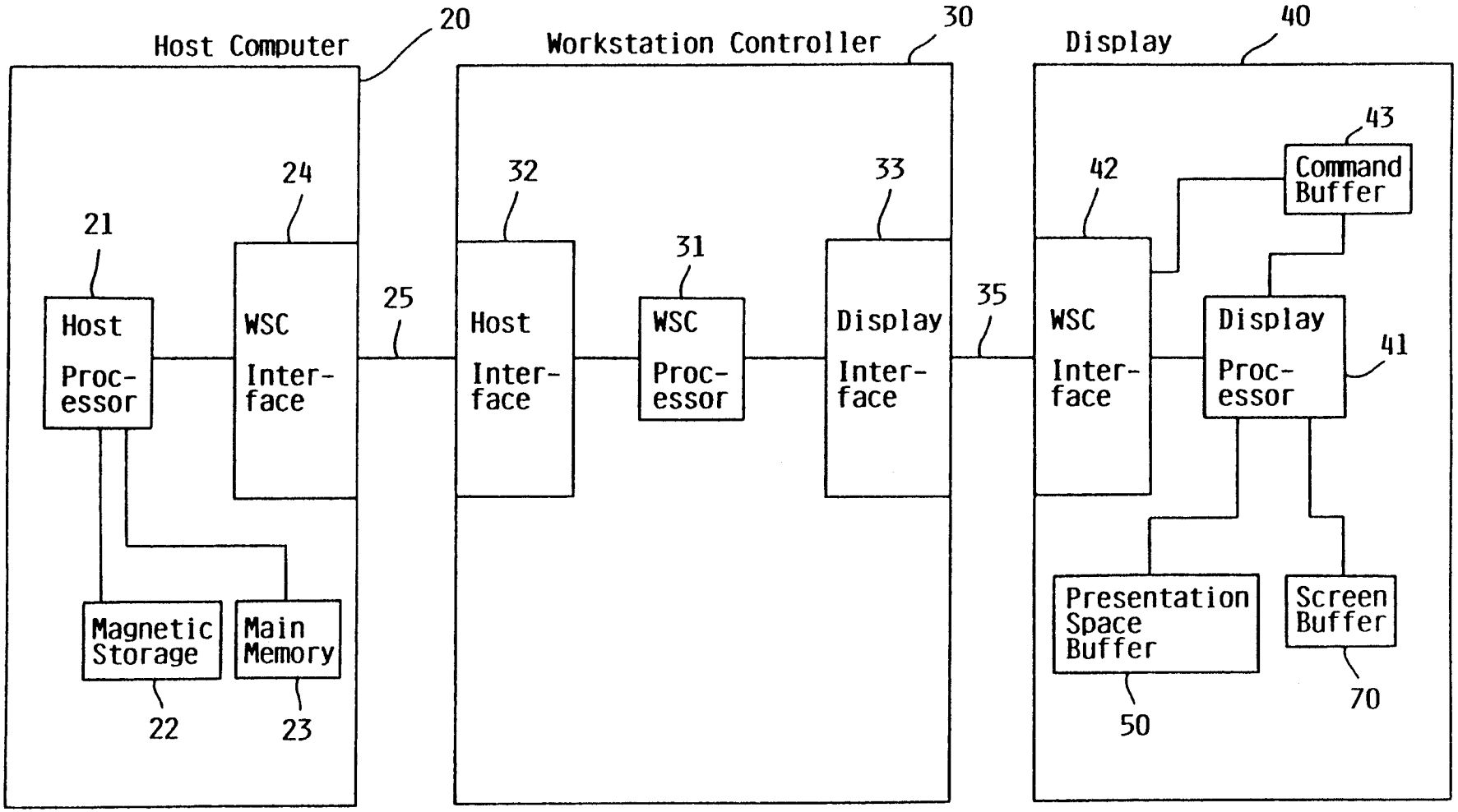
FIG. 1 shows a block diagram of the computer system of the invention.

FIG. 1 shows a block diagram of the computer system of the invention. Host computer 20 is connected to workstation controller (WSC) 30, which is connected to display 40. In the preferred embodiment, host computer 20 is an IBM Application System/400 computer, although any host computer could be used. WSC 30 is an IBM 6040 Workstation Controller or other AS/400 Workstation Controller, although any workstation controller could be used. Display 40 is an IBM 3477 display, although any display suitably programmed and configured as described herein could be used. In the first alternate embodiment, display 40 is a standalone "smart" display, such as an IBM Personal System/2 computer. In this alternate embodiment, a workstation controller and a host computer are not necessary to perform the invention. Although direct connections are shown between host 20, WSC 30 and display 40 in FIG. 1, other types of connections could be used, such as remote connections over telephone lines, local area networks, etc.

Host 20 has host processor 21 connected to magnetic storage 22, main memory 23, and workstation controller interface 24. WSC 30 has WSC processor 31 connected to host interface 32 and display interface 33. Display 40 has display processor 41 connected to WSC interface 42, command buffer 43, presentation space buffer 50, and screen buffer 70. Display 40 is shown in more detail in a co-pending application entitled "Enhanced Data Stream Processing in a Fixed Function Terminal" filed Apr. 17, 1989 and assigned to the assignee of this invention, incorporated herein by reference. Display processor 41 of this application is processor 200 in the referenced application. Likewise, command buffer 43 is referred to as communications buffer 210, and WSC interface 42 is referred to as I/O interface 214. Presentation space buffer 50 and screen buffer 70 are located in display store 222 in the referenced application.

Figure 2:
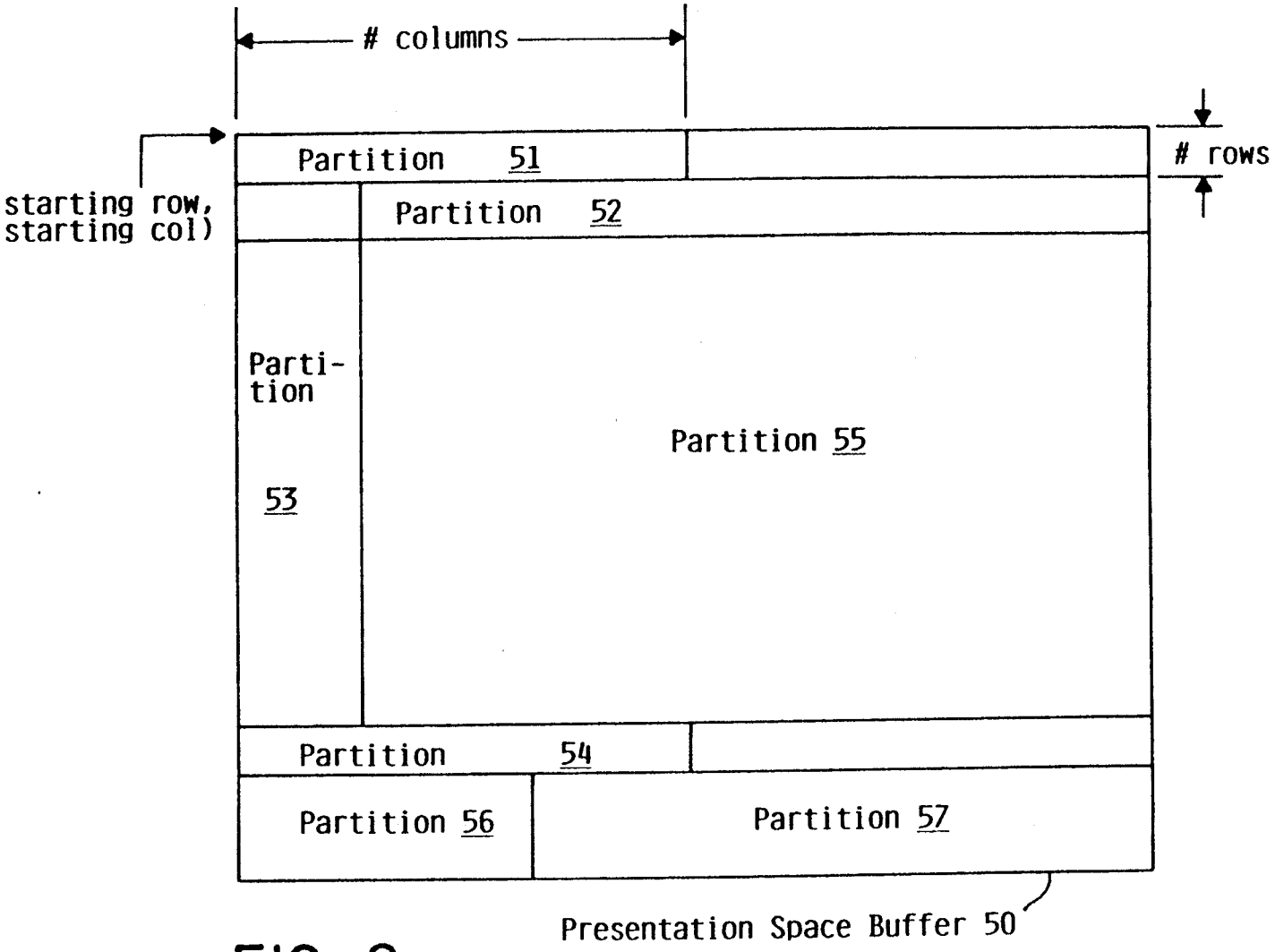
FIG. 2 shows an example of how the presentation space buffer of the invention can be partitioned.

FIG. 2 shows presentation space buffer 50 of the invention in more detail. Presentation space buffer 50 is made up if one or more partitions. In FIG. 2, partitions 51-57 have been defined and are shown as an exemplary way of a nearly infinite number of ways partitions can be defined in the invention, as will be discussed later. A partition can be any size from one byte up to the entire size of presentation space buffer 50, and can be located anywhere in presentation space buffer 50.

Figure 3:
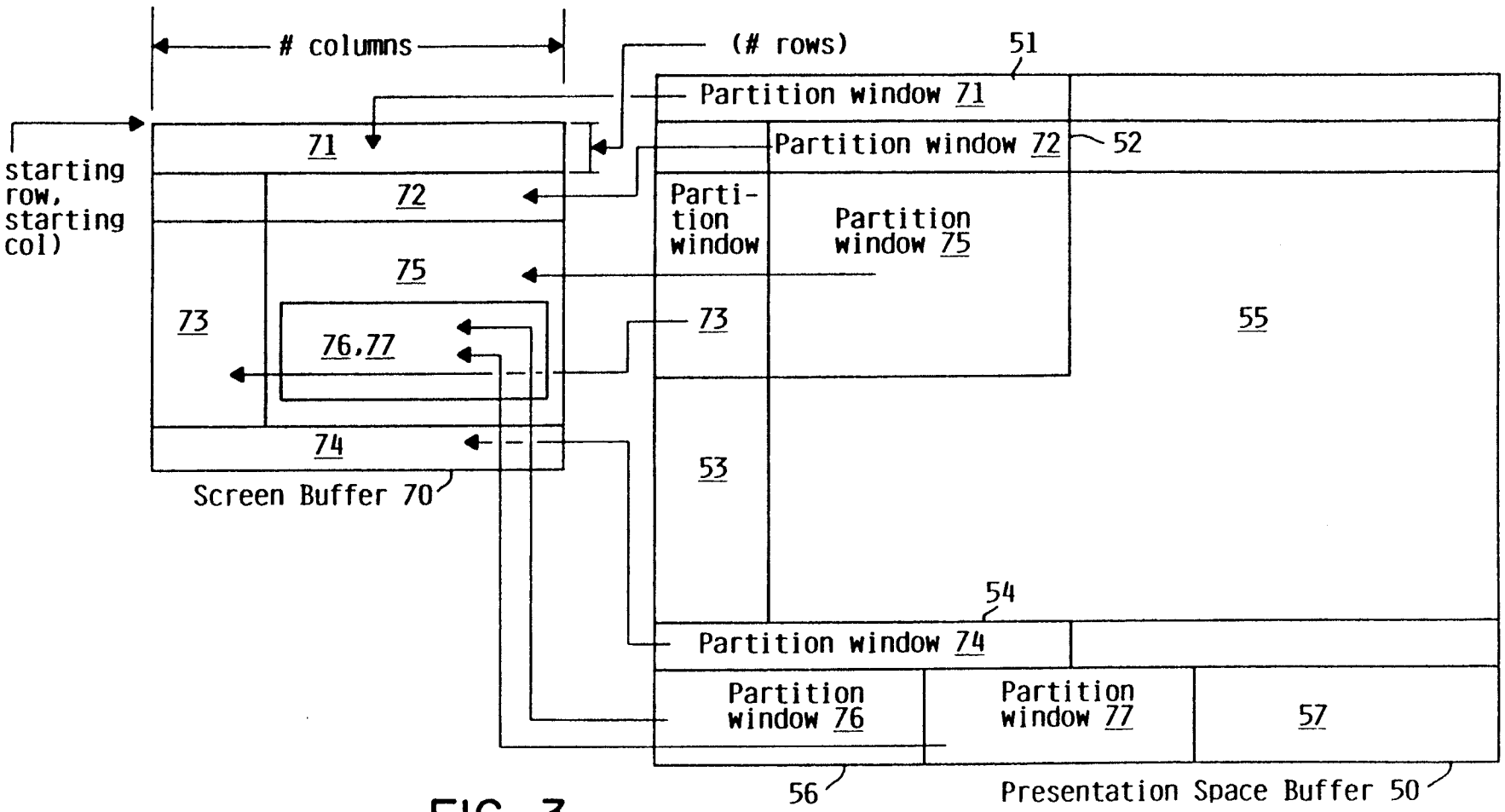
FIG. 3 shows how partition windows from the presentation space buffer map into the screen buffer of the invention.

FIG. 3 shows how partition windows from presentation space buffer 50 map into screen buffer 70 of the invention. Each partition has a partition window which maps into screen buffer 70. The partition window can be any size from one byte up to the size of its associated partition, but not exceeding the size of screen buffer 70. For example, partition 51 has partition window 71 which is the same size as partition 51. Partition 55 has partition window 75 which is considerably smaller than partition 55. Note that more than one partition window can be mapped into the same space in screen buffer 70. For example, partition windows 76, and 77 are mapped into the exact same space in screen buffer 70, and both of these partition windows are mapped into a portion of the same space in screen buffer 70 as is partition window 75.

Although many partition windows can be mapped into the same space in screen buffer 70, only partition windows-associated with partitions that have been activated are actually written into screen buffer-70. When previously inactive partition is activated, the partition window is written to the screen buffer, possibly partially or completely overlaying other partition windows. This feature is particularly useful for pop-up menus or help text that can be occasionally displayed to the user.

FIG. 4 shows how scroll groups of the invention can be defined. One or more scroll groups can be defined, and one or more partitions can be assigned to each scroll group. Each defined scroll group has a vertical scroll trigger and a horizontal scroll trigger. FIG. 4 shows how partitions 51-57 of FIG. 3 can be assigned to scroll groups. Partitions 51, 54, and 56 have not been assigned to a scroll group. Partitions 52, 53, and 55 have been assigned to scroll group 61. Partition 57 has been assigned to scroll group 63. Scroll group 61 would have, for example, a horizontal trigger of five and a vertical trigger of three. Display 40 monitors the movement of the cursor within a partition window. When the cursor gets close enough to a boundary of a partition window to trigger a scroll trigger, the within five spaces of the right edge, the horizontal scroll trigger of scroll group 61 is triggered. Partition window 75 shifts to the right in presentation space buffer 50. In this manner, updated data is now contained in partition window 75. Since partition 52 is also in scroll group 61, partition window 72 also shifts to the right in presentation space buffer 50. Note that partition window 73 is not shifted to the right in presentation space buffer 50 even though its associated partition 53 is in scroll group 61. This is because a partition window cannot shift beyond the boundaries of its associated partition.

If the cursor is located in partition window 75 and gets within three spaces of the bottom edge, the vertical scroll trigger of scroll group 61 is triggered. Partition window 75 shifts down in presentation space buffer 50. In this manner, updated data is now contained in partition window 75. Since partition 53 is also in scroll group 61, partition window 73 also shifts down in presentation space buffer 50. Note that partition window 72 is not shifted down in presentation space buffer 50 even though its associated partition 52 is in scroll group 61. This is because a partition window cannot shift beyond the boundaries of-its associated partition.

Note that since partitions 51, 54, 56 have not been assigned to any scroll groups, partition windows 71, 74, and 76 will not be able to shift within presentation space buffer 50. Since partition windows 71, 74, and 76 are the same size as partitions 51, 54, and 56, respectfully, there is no need to shift these partition windows within presentation space buffer 50. Therefore, it is not necessary to assign these partitions to a scroll group. Generally, if a partition window is smaller than its associated partition, the partition will be assigned to a scroll group, so that all of the data in the partition can be displayed to the user.

Figure 5A:
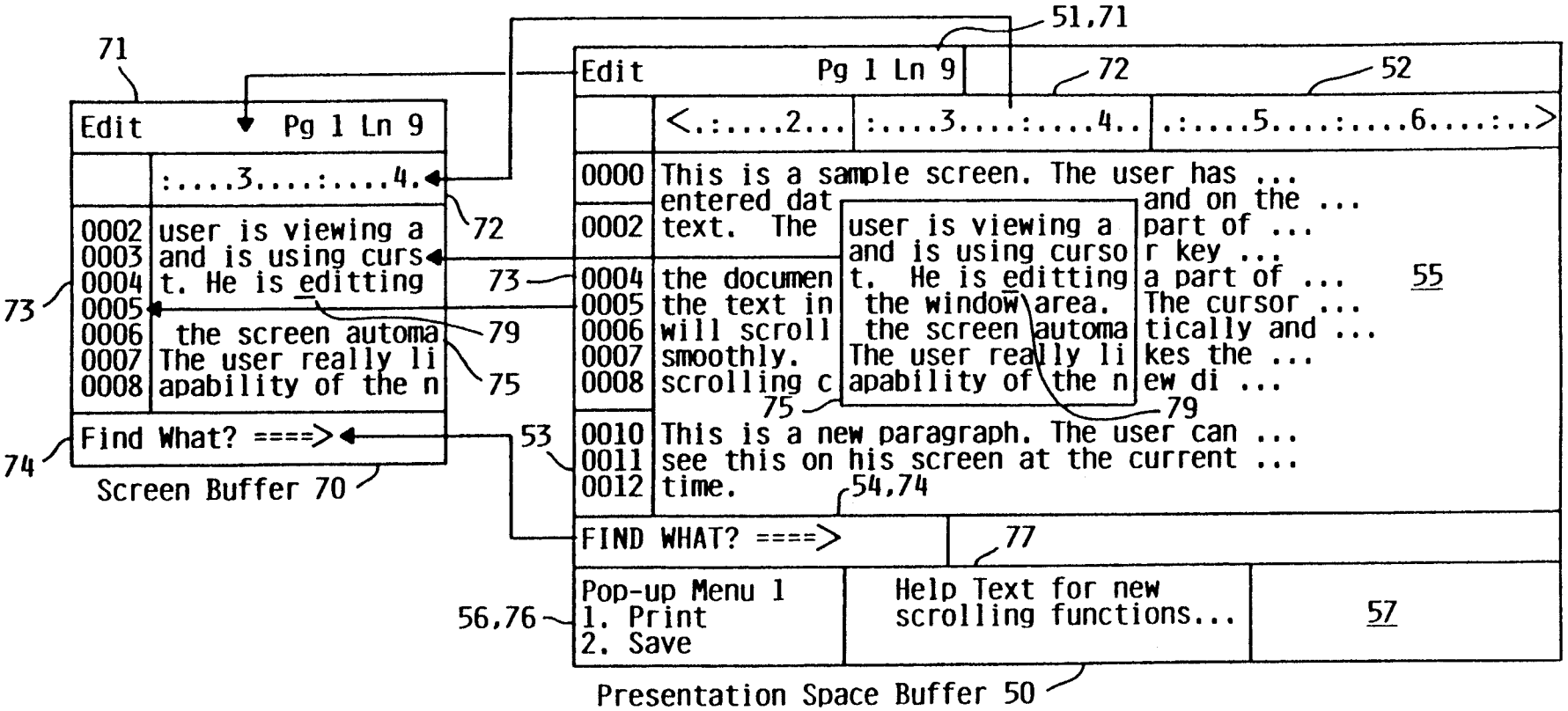
FIGS. 5A-5B show examples of how the partition windows associated with active partitions are written to the screen buffer and displayed to a computer user.
Figure 5B:
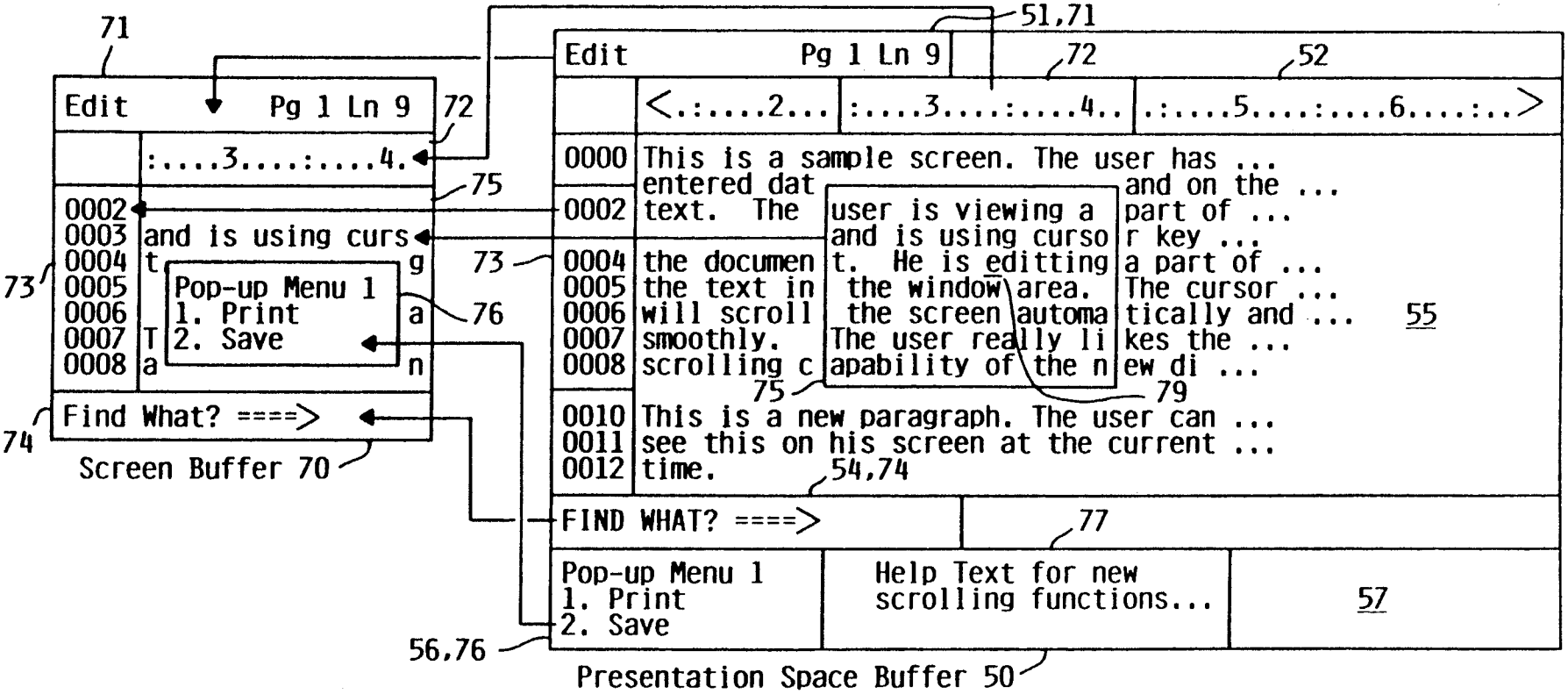

FIGS. 5A–5B show examples of how the partition windows associated with active partitions are written to screen buffer 70 and displayed to a computer user in a word processing application. In FIG. 5A, partitions 51–55 are active; therefore, associated partition windows 71–75 are written to screen buffer 70. Partitions 56 and 57 are not active, so associated partition windows 76 and 77 are not written to screen buffer 70.

Note that screen buffer 70 is shown with only a few rows and columns in FIGS. 5A and 5B to illustrate the concept. In actuality, screen buffer 70 would be much bigger, such as 24 rows by 80 columns, the size of a conventional display screen. However, it could be any size. Likewise, presentation space buffer 50 would be much bigger, up to 95 rows by 256 columns in the preferred embodiment, but it could be any size larger than screen buffer 70.

Cursor 79 is located in partition window 75 in screen buffer 70. When cursor 79 gets within five spaces of the right edge, the horizontal scroll trigger of scroll group 61 is triggered. Partition windows 75 and 72 shift to the right in presentation space buffer 50, as discussed earlier. When cursor 79 gets within three spaces of the bottom edge, the vertical scroll trigger of scroll group 61 is triggered. Partition windows 75 and 73 shift down in presentation space buffer 50, as discussed earlier.

FIG. 5B shows screen buffer 70 after partition 56 has been activated. When partition 56 is activated, associated partition window 76 is written to screen buffer 70 at its mapped location. Note that since partition window 76 is mapped to part of the same location in screen buffer 70 as partition window 75, a portion of partition window 75 is overlayed by partition window 76.

Figure 6:
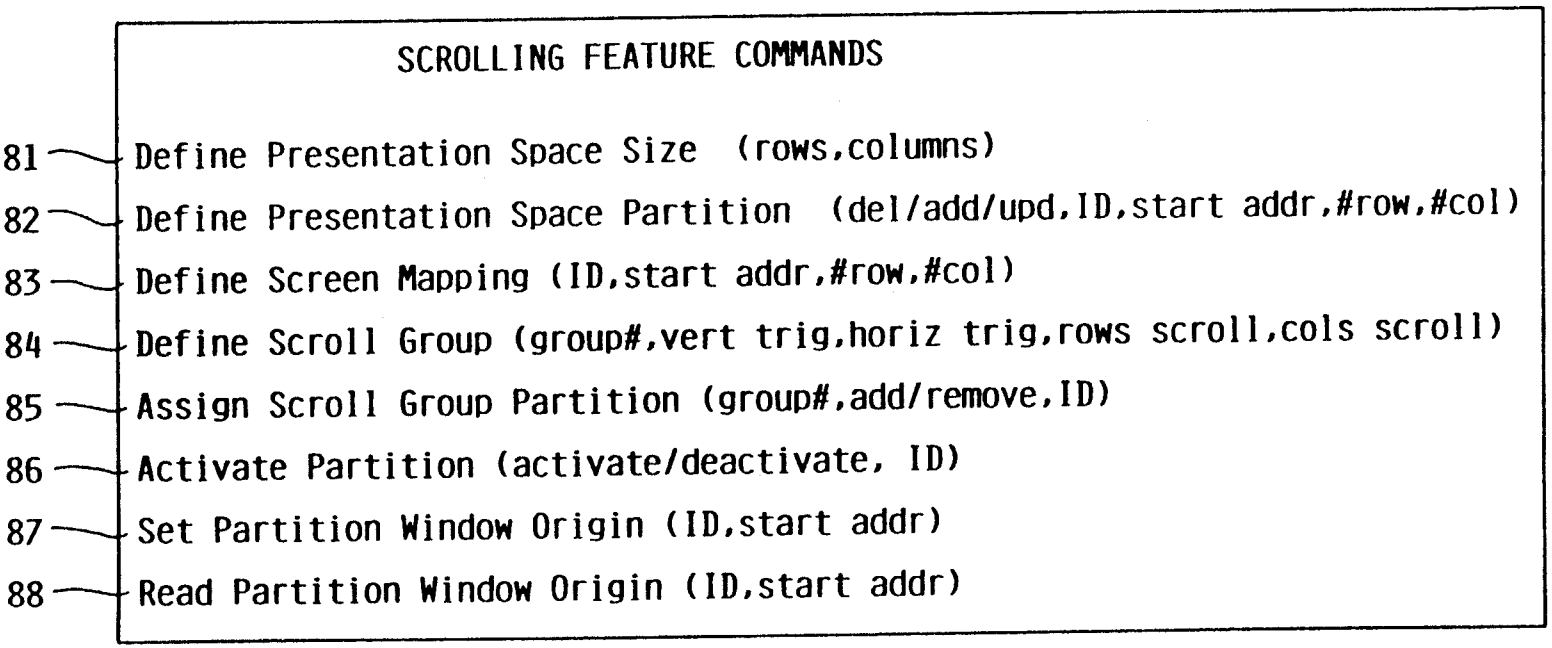
FIG. 6 shows the scrolling feature commands of the invention.

FIG. 6 shows the Scrolling Feature Commands of the invention that are used to format presentation space buffer 50 and screen buffer 70. In the preferred embodiment, these commands are generated and sent from WSC 30 to command buffer 43 in display 40 (FIG. 1), whereupon they are executed by display 40, as will be discussed in more detail later. Command 81 is the Define Presentation Space Size Command. This command defines the size of presentation space buffer 50. The number of rows and columns are parameters for this command. In the preferred embodiment, any size up to 95 rows and 256 columns can be specified in this command.

Command 82 is the Define Presentation Space Partition Command. This command is used to define a partition within presentation space buffer 50. The first parameter for this command specifies whether a partition is to be added to presentation space buffer 50, deleted from presentation space buffer 50, or updated. The second parameter identifies the partition to be added, deleted, or updated. The next parameter gives the row and column of presentation space buffer 50 where this partition starts. The final parameter specifies the size of this partition by providing the number of rows and columns for this partition. In the preferred embodiment, up to 15 unique partitions can be defined for presentation space buffer, but this number could conceivably be considerably larger than this if desired, since a partition can be as small as one space (one row and one column).

Command 83 is the Define Screen Mapping Command. This command is used to define how a partition window will be mapped into screen buffer 70. The first parameter for this command identifies the partition to be mapped. The next parameter gives the row and column of screen buffer 70 where this partition window starts. The final parameter specifies the size of this partition window by providing the number of rows and columns for this partition window. In the preferred embodiment, a partition window can be any size between one space (one row and one column) up to the size of its associated partition but not exceeding the size of screen buffer 70. Note that more than one partition window can be mapped to the same location in screen buffer 70. A mapped partition window is not written to screen buffer 70 until its associated partition is activated by an Activate Partition Command, as will be discussed later.

Command 84 is the Define Scroll Group Command. This command is used to define how a scroll group will be processed. The first parameter for this command identifies the scroll group number. In the preferred embodiment, up to 15 groups can be defined. The next parameter sets the vertical scroll trigger for the scroll group. For example, if the vertical scroll trigger was set to three, the partition windows associated with the partitions in the scroll group will all shift down in presentation space buffer 50 whenever the cursor is within three spaces of the bottom edge of a partition window. Likewise, the partition windows associated with the partitions in the scroll group will all shift up in presentation space buffer 50 whenever the cursor is within three spaces of the top edge of a partition window. Of course, the partition window cannot shift beyond the boundaries of its associated partition.

The next parameter sets the horizontal scroll trigger for the scroll group. For example, if the horizontal scroll trigger was set to five, the partition windows associated with the partitions in the scroll group will all shift right in presentation space buffer 50 whenever the cursor is within five spaces of the right edge of a partition window. Likewise, the partition windows associated with the partitions in the scroll group will all shift left in presentation space buffer 50 whenever the cursor is within five spaces of the left edge of a partition window. Of course, the partition window cannot shift beyond the boundaries of its associated partition.

The next parameter of Define Scroll Group Command 84 specifies the number of rows to shift the presentation window when the vertical scroll trigger is triggered. For example, if the number of rows to shift is set to ten, and the vertical scroll trigger was set to three, the partition windows associated with the partitions in the scroll group will all shift down ten rows in presentation space buffer 50 whenever the cursor is within three spaces of the bottom edge of a partition window. Likewise, the partition windows associated with the partitions in the scroll group will all shift up ten rows in presentation space buffer 50 whenever the cursor is within three spaces of the top edge of a partition window. Of course, the partition window cannot shift beyond the boundaries of its associated partition.

The last parameter of Define Scroll Group Command 84 specifies the number of columns to shift the presentation window when the horizontal scroll trigger is triggered. For example, if the number of columns to shift is set to fifteen, and the horizontal scroll trigger was set to five, the partition windows associated with the partitions in the scroll group will all shift right fifteen columns in presentation space buffer 50 whenever the cursor is within five spaces of the right edge of a partition window. Likewise, the partition windows associated with the partitions in the scroll group will all shift left fifteen columns in presentation space buffer 50 whenever the cursor is within five spaces of the left edge of a partition window. Of course, the partition window cannot shift beyond the boundaries of its associated partition.

Command 85 is the Assign Scroll Group Partition Command. This command is used to assign a partition to a scroll group. The first parameter for this command identifies the scroll group number. The next parameter states whether the specified partition is to be added or removed from this scroll group. The last parameter identifies the partition to be added or removed.

Command 86 is the Activate Partition Command. This command activates a partition. Once a partition is activated, its associated partition window, already mapped to screen buffer 70, is written to screen buffer 70. The first parameter for this command states whether the specified partition is to be activated or deactivated. The last parameter identifies the partition to be activated or deactivated.

Command 87 is the Set Partition Window Origin Command. This command is used to move a partition window even though the cursor has not triggered a shift of the partition window. This command is used, among other things, to initially position the partition window within its associated partition in presentation space buffer 50. The first parameter identifies the partition. The next parameter gives the row and column within the associated partition in presentation space buffer 50 where this partition window starts. The size of the partition window is known from Define Screen Mapping Command 83. When Set Window Origin Command 87 is executed by display 40, the other partition windows whose associated partitions are in the same scroll group are also shifted.

Command 88 is the Read Partition Window Origin Command. This command reads the origin of the partition window. The first parameter identifies the partition. The next parameter returns the row and column within the associated partition in presentation space buffer 50 where this partition window starts.

In the preferred embodiment, the above commands are generated and sent from WSC 30 to command buffer 43 in display-40 (FIG. 1), whereupon they are executed by display 40, as will be discussed in more detail later. However, in the first alternate embodiment, where display 40 is a standalone display, these commands are all generated and executed internally within display 40.

Figure 7A:
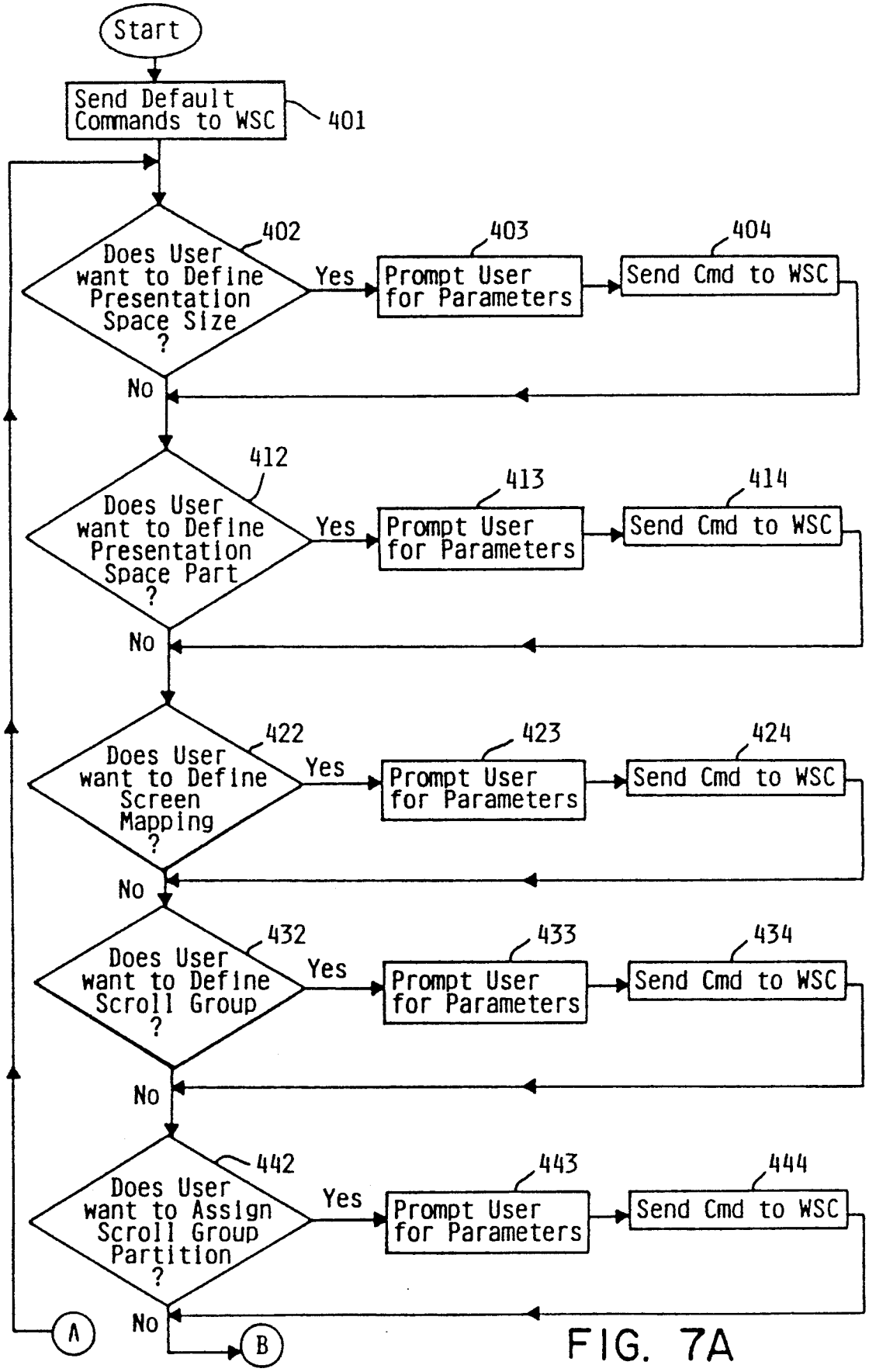
FIGS. 7A-7B shows a flowchart of the operation of the host computer of the invention.
Figure 7B:
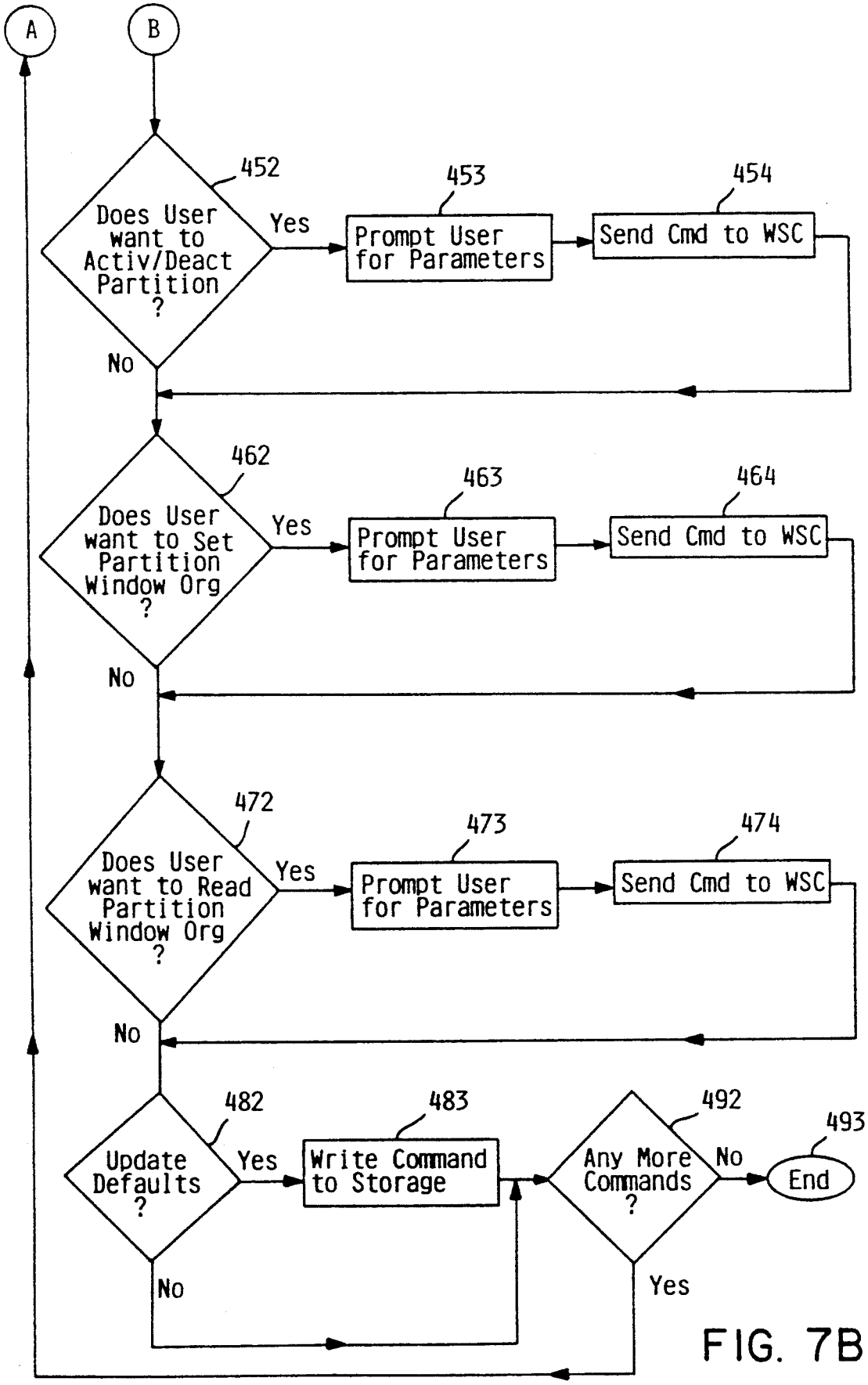

FIG. 7 shows a flowchart of the operation of host 20 of the invention. In the preferred embodiment, this flowchart is performed by host processor 21. Block 401 retrieves default scrolling feature commands for this particular application from magnetic storage 22 and sends them to WSC 30. These default commands set up a particular application, such as the word processing application shown in FIGS. 5A–5B. The remainder of the flowchart checks to see if the user wants to change these default scrolling feature commands. The user can, for example, be an end user or an application developer.

Block 402 asks if the user wants to define the presentation space size. If so, the user is prompted for the parameters of this scrolling feature command shown in FIG. 6, in block 403.

Block 412 asks if the user wants to define a presentation space partition. If so, the user is prompted for the parameters of this scrolling feature command shown in FIG. 6, in block 413. Block 414 sends Define Presentation Space Partition Command 82 to WSC 30.

Block 422 asks if the user wants to define screen mapping. If so, the user is prompted for the parameters of this scrolling feature command shown in FIG. 6, in block 423. Block 424 sends Define Screen Mapping command 83 to WSC 30.

Block 432 asks if the user wants to define a scroll group. If so,, the user is prompted for the parameters of this scrolling feature command shown in FIG. 6, in block 433. Block 434 sends Define Scroll Group command 84 to WSC 30.

Block 442 asks if the user wants to assign a scroll group partition. If so, the user is prompted for the parameters of this scrolling feature command shown in FIG. 6, in block 443. Block 444 sends Assign Scroll Group Partition command 85 to WSC 30.

Block 452 asks if the user wants to activate or deactivate a partition. If so, the user is prompted for the parameters of this scrolling feature command shown in FIG. 6, in block 453. Block 454 sends Activate Partition Command 86 to WSC 30.

Block 462 asks if the user wants to set a partition window origin. If so, the user is prompted for the parameters of this scrolling feature command shown in FIg. 6, in block 463. Block 464 sends Set Partition Window Origin command 87 to WSC 30.

Block 472 asks if the user wants to read a partition window origin. If so, the user is prompted for the partition ID, as shown in FIG. 6, in block 473. Block 474 sends Read Partition Window Origin command 88 to WSC 30.

Block 482 asks if the user wishes to save these commands and update the default commands. If so, block 483 writes the command to magnetic storage 22, where it will be accessed the next time the default commands for this application are sent to WSC 30 in block 401. Block 492 asks if the user wishes to create any more commands. If so, control loops back to block 402. If not, the flowchart ends in block 493.

Although the flowchart of FIG. 7 is performed by host processor 21 in the preferred embodiment, it would be performed by display processor 41 in the first alternate embodiment, (where display 40 is a standalone personal computer, as discussed above) with a few minor changes. Specifically, block 401 would place all the default commands directly into command buffer 43 to be processed in a manner as will be seen in FIG. 10. Likewise, blocks 404, 414 424, 434, 444, etc. would place the command directly into command buffer 43.

Figure 8:
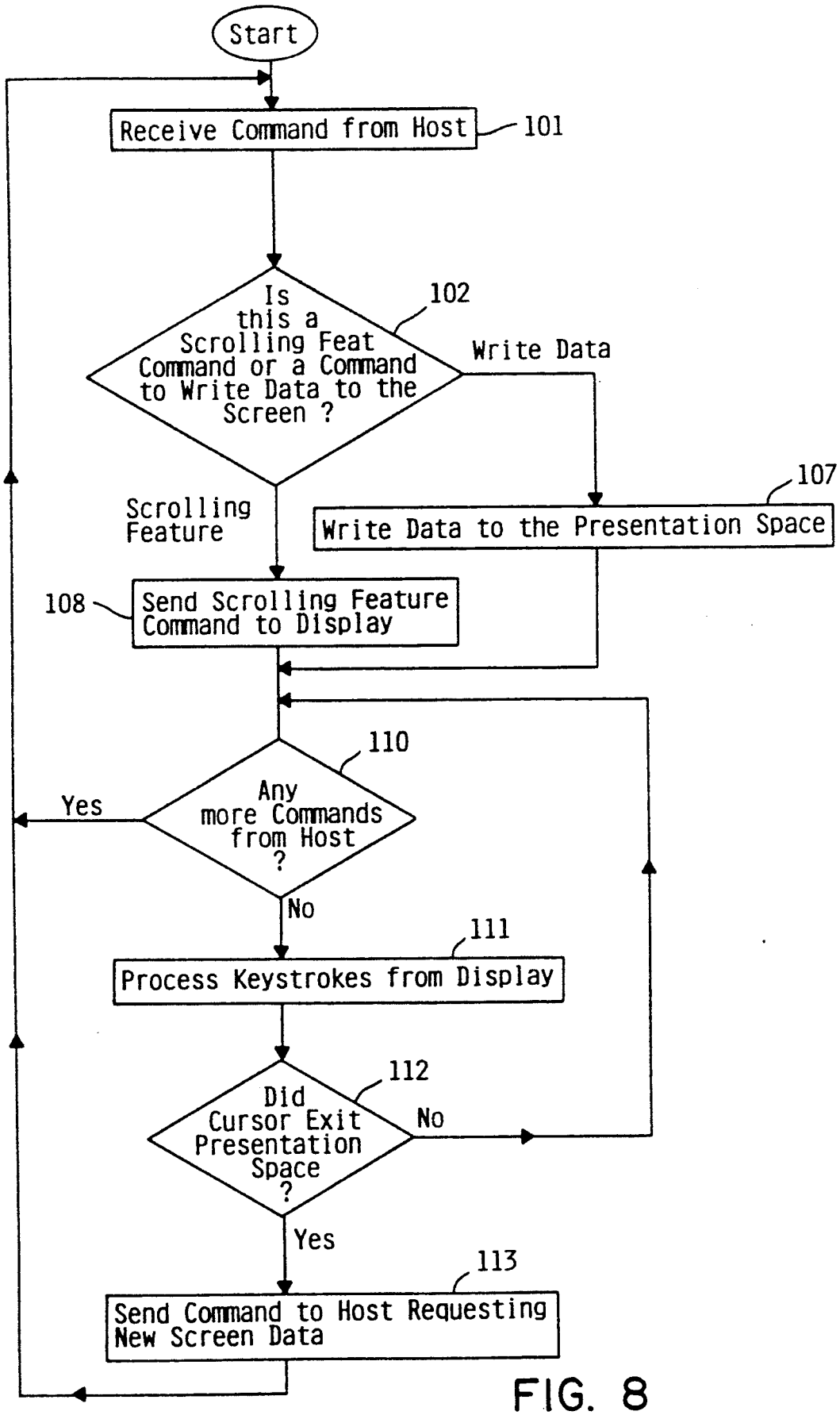
FIG. 8 shows a flowchart of the operation of the workstation controller of the invention.
Figure 9:
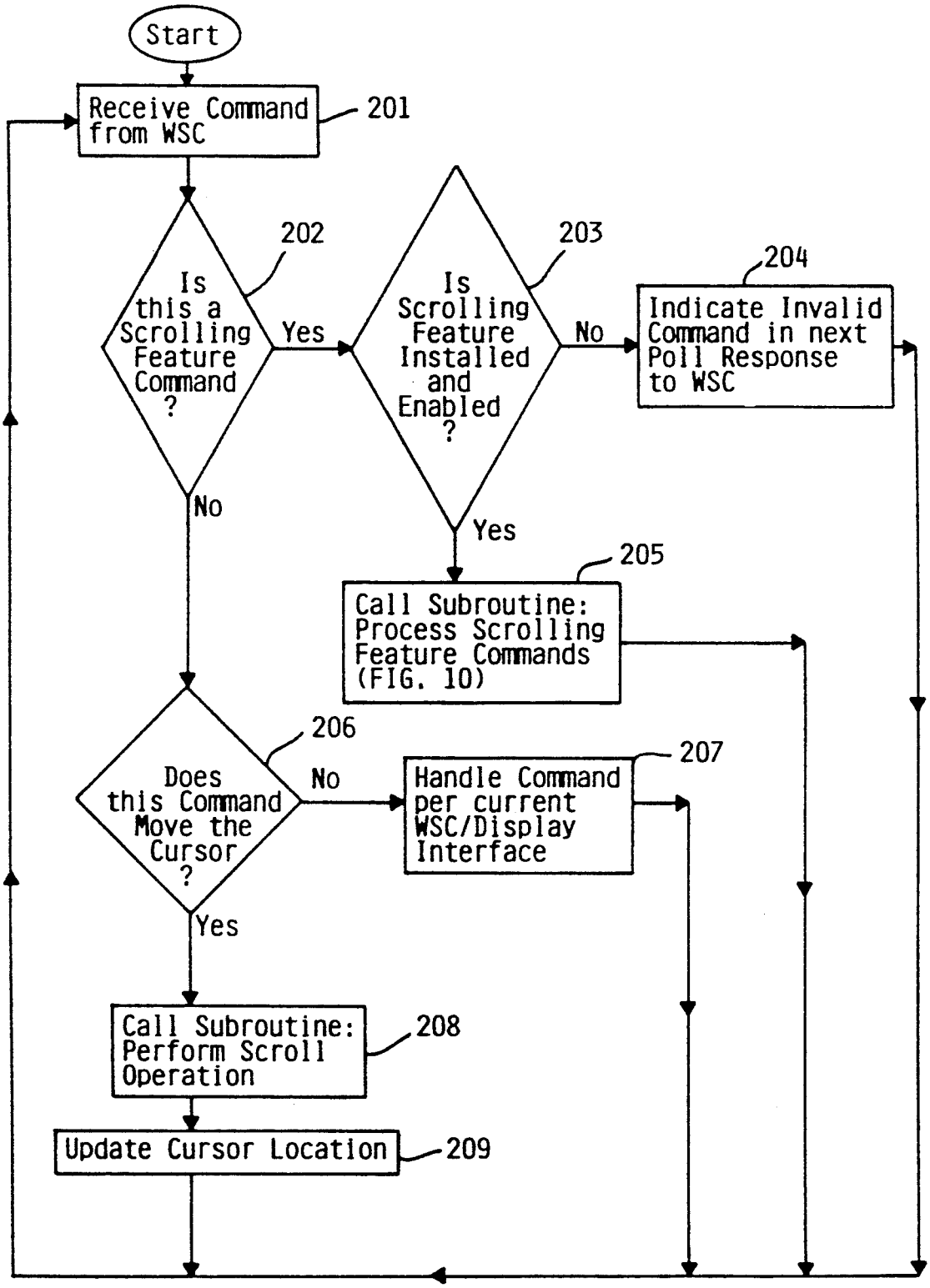
FIGS. 9-12B show flowcharts of the operation of the display of the invention.

FIG. 8 shows a flowchart of the operation of workstation controller 30 of the invention. In the preferred embodiment, this flowchart is performed by WSC processor 31. Block 101 receives a command from host 20. This command can be either a scrolling feature command sent to WSC 30 in FIG. 7 or a conventional command to write data to the display screen. If it is a scrolling feature command, block 105 is answered affirmatively and block 108 sends the scrolling feature command to command buffer 43 of display 40. If it is not a scrolling feature command, block 107 writes the data to presentation space buffer 50. Note that WSC 30 does not write data directly into screen buffer 70.

Block 110 checks to see if there are any more commands from host 20 to process. If so, control returns back to block 101. If not, block 111 processes any keystrokes returned from display 40 and adjusts the cursor position in presentation space buffer 50 accordingly.

Block 112 checks to see if the cursor exited presentation space buffer 50. If it didn't, control loops back to block 110, where WSC 30 again checks for more commands from the host. If the cursor did exit presentation space buffer 50, block 113 sends a command to host 20 requesting new data for presentation space buffer 50 which is written to presentation space buffer 50 in block 107 the next time through the loop. Flow of control returns back to block 101.

FIGS. 9-12 show flowcharts of the operation of the display of the invention. In the preferred embodiment, these flowcharts are performed by display processor 41. Block 201 of FIG. 9 receives a command from WSC 30. Block 202 checks to see if the command is one of the Scrolling Feature Commands shown in FIG. 6. If so, block 203 checks to see if the scrolling feature is installed and enabled on display 40. If not, an error message is posted in block 204 and flow of control returns to block 201. If the scrolling feature is installed on display 40, block 205 calls the Process Scrolling Feature Commands Subroutine shown in FIG. 10.

If block 202 is answered negatively, block 206 asks if this command moves the cursor. If not, block 207 handles the command in a normal manner, such as writing data to or reading data from presentation space buffer 50, and flow of control returns to block 201. If block 206 is answered affirmatively, block 208 calls the Perform Scroll Operation Subroutine of FIG. 12.

The Process Scrolling Feature Commands Subroutine of FIG. 10 will now be discussed. Block 221 asks if there are any more commands from WSC 30 in command buffer 43 that need to be processed. Block 221 is answered affirmatively the first time through the loop, and block 222 fetches the next Scrolling Feature Command from command buffer 43. Block 223 calls the Decode/Handle Scrolling Feature Commands subroutine of FIG. 11. After control returns from the Decode/Handle Scrolling Feature Commands subroutine, block 224 checks to see if an invalid command was detected. If not, control returns to block 221. If so, block 225 posts an error message, and the program in block 226 returns to block 201 of FIG. 9. This is done for integrity purposes. Likewise, if block 221 is answered negatively, the program in block 226 returns to block 201 of FIG. 9.

The Decode/Handle Scrolling Feature Commands subroutine of FIG. 11 will now be discussed. Block 241 checks to see if the Scrolling Feature Command is Define Presentation Space Size Command 81 (FIG. 6). If so, block 242 erases all data in presentation space buffer 50 and sets presentation space buffer 50 to the size specified by the parameters in the command. The subroutine then returns in block 243 to block 224 in FIG. 10.

If block 241 is answered negatively, block 244 checks to see if the Scrolling Feature Command is Define Presentation Space Partition Command 82 (FIG. 6). If so, block 245 makes sure that the size of presentation space buffer 50 has previously been defined. If not, block 246 posts an error message and the subroutine returns in block 243. If block 245 is answered affirmatively, block 247 checks to see if any parameters associated with the command are invalid. If so, block 248 posts an error message and the subroutine returns in block 243. If block 247 is answered negatively, block 249 either deletes, adds or updates the specified partition based on the parameters of the command. If the partition is added or updated, the parameters in the command that specify starting address and size are used to create the partition, as has been discussed in conjunction with FIG. 6. The subroutine then returns in block 243.

If block 244 is answered negatively, block 254 checks to see if the Scrolling Feature Command is Define Screen Mapping Command 83 (FIG. 6). If so, block 255 makes sure that the size of presentation space buffer 50 has previously been defined and partitioned. If not, block 256 posts an error message and the subroutine returns in block 253 to block 224 in FIG. 10. If block 255 is answered affirmatively, block 257 checks to see if any parameters associated with the command are invalid. If so, block 258 posts an error message and the subroutine returns in block 253. If block 257 is answered negatively, block 259 maps the partition window specified in the command to the location in screen buffer 50 specified in the command, as has been discussed in conjunction with FIG. 6. The subroutine then returns in block 253 to block 224 in FIG. 10.

If block 254 is answered negatively, block 264 checks to see if the Scrolling Feature Command is Define Scroll Group Command 84 (FIG. 6). If so, block 265 makes sure that the size of presentation space buffer 50 has previously been defined and partitioned. If not, block 266 posts an error message and the subroutine returns in block 263 to block 224 in FIG. 10. If block 265 is answered affirmatively, block 267 checks to see if any parameters associated with the command are invalid. If so, block 268 posts an error message and the subroutine returns in block 263. If block 267 is answered negatively, block 269 defines the scroll group as specified by the parameters of the command, as has been discussed in conjunction with FIG. 6. The subroutine then returns in block 263 to block 224 in FIG. 10.

If block 264 is answered negatively, block 274 checks to see if the Scrolling Feature Command is Assign Scroll Group Partition Command 85 (FIG. 6). If so, block 275 makes sure that the size of presentation space buffer 50 has previously been defined and partitioned, and that the scroll group has been defined. If not, block 276 posts an error message and the subroutine returns in block 273 to block 224 in FIG. 10. If block 275 is answered affirmatively, block 227 checks to see if any parameters associated with the command are invalid. If so, block 278 posts an error message and the subroutine returns in block 273. If block 277 is answered negatively, block 279 either adds or removes the partition to/from the scroll group, as specified by the parameters of the command, as has been discussed in conjunction with FIG. 6. The subroutine then returns in block 273 to block 224 in FIG. 10.

If block 274 is answered negatively, block 284 checks to see if the Scrolling Feature Command is Activate Partition Command 86 (FIG. 6). If so, block 285 makes sure that the size of presentation space buffer 50 has previously been defined and partitioned, the partition has been defined, and that the partition window has been mapped and defined. If not, block 286 posts an error message and the subroutine returns in block 283 to block 224 in FIG. 10. If block 285 is answered affirmatively, block 287 checks to see if any parameters associated with the command are invalid. If so, block 288 posts an error message and the subroutine returns in block 283. If block 287 is answered negatively, block 289 either activates or deactivates the partition specified by the parameters of the command. After the partition is activated, its associated partition window is written to screen buffer 70, and may overlay one or more existing partition windows, as has been discussed previously.

Figure 10:
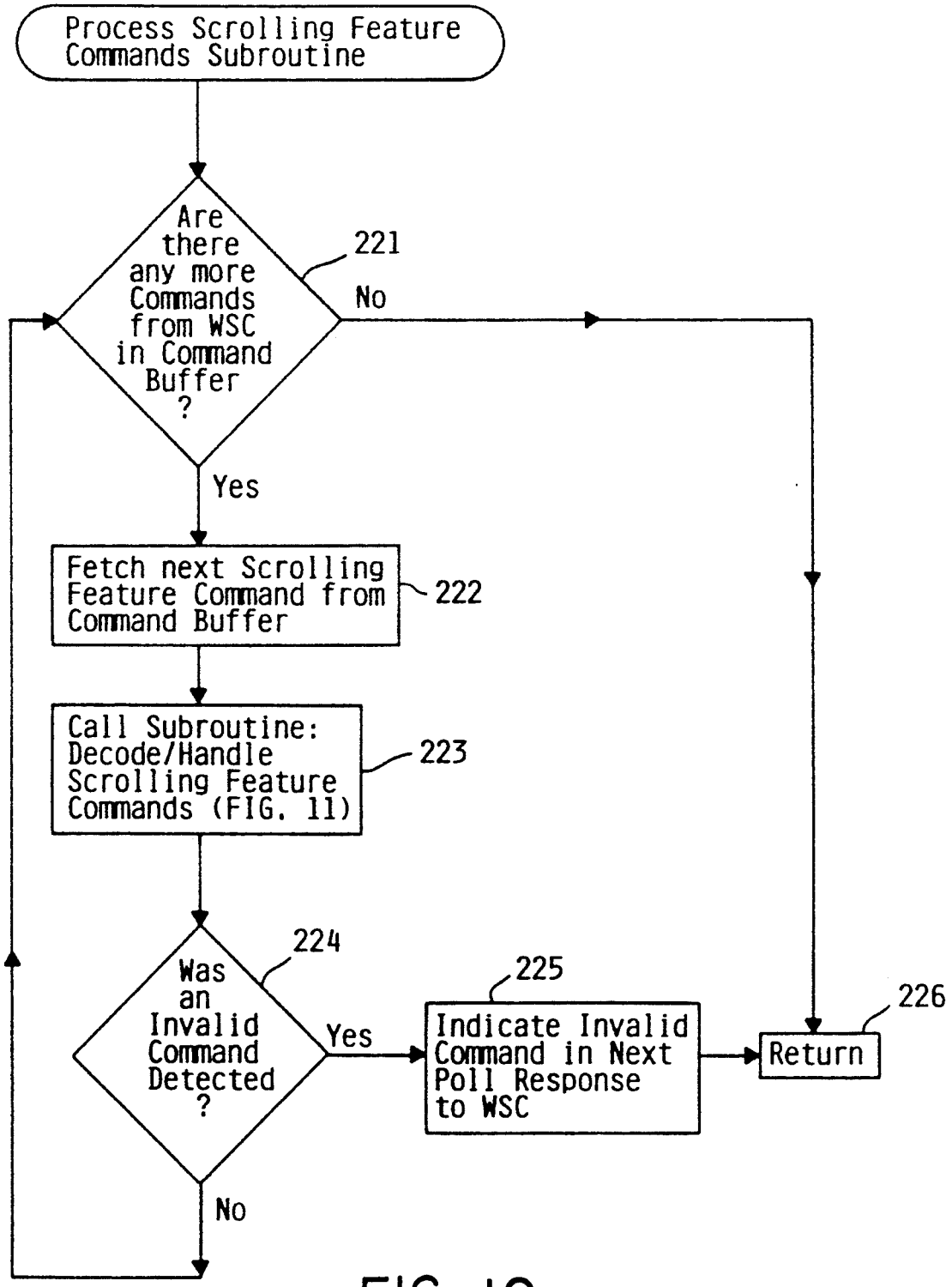
Figure 11A:
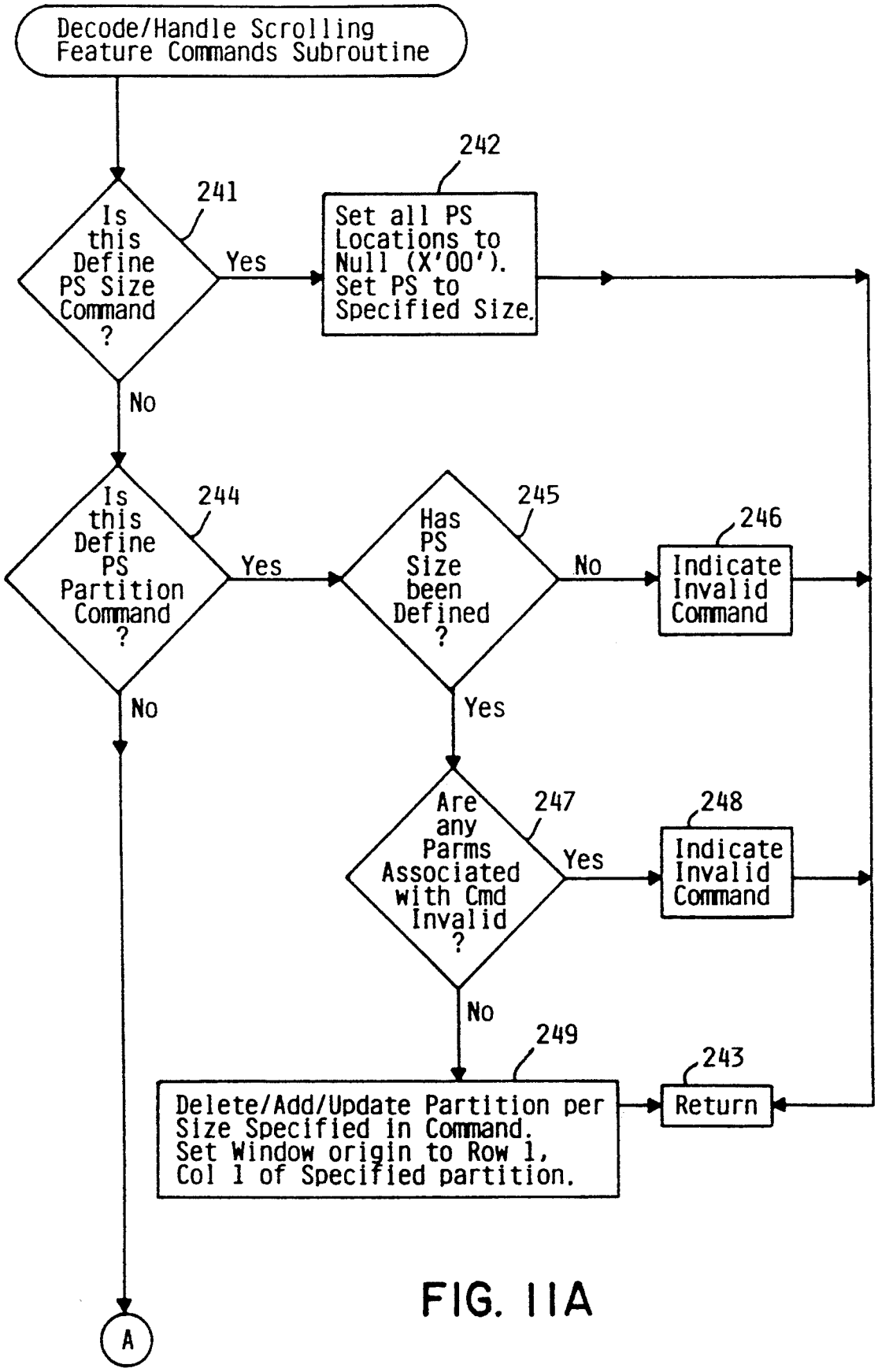
Figure 11B:
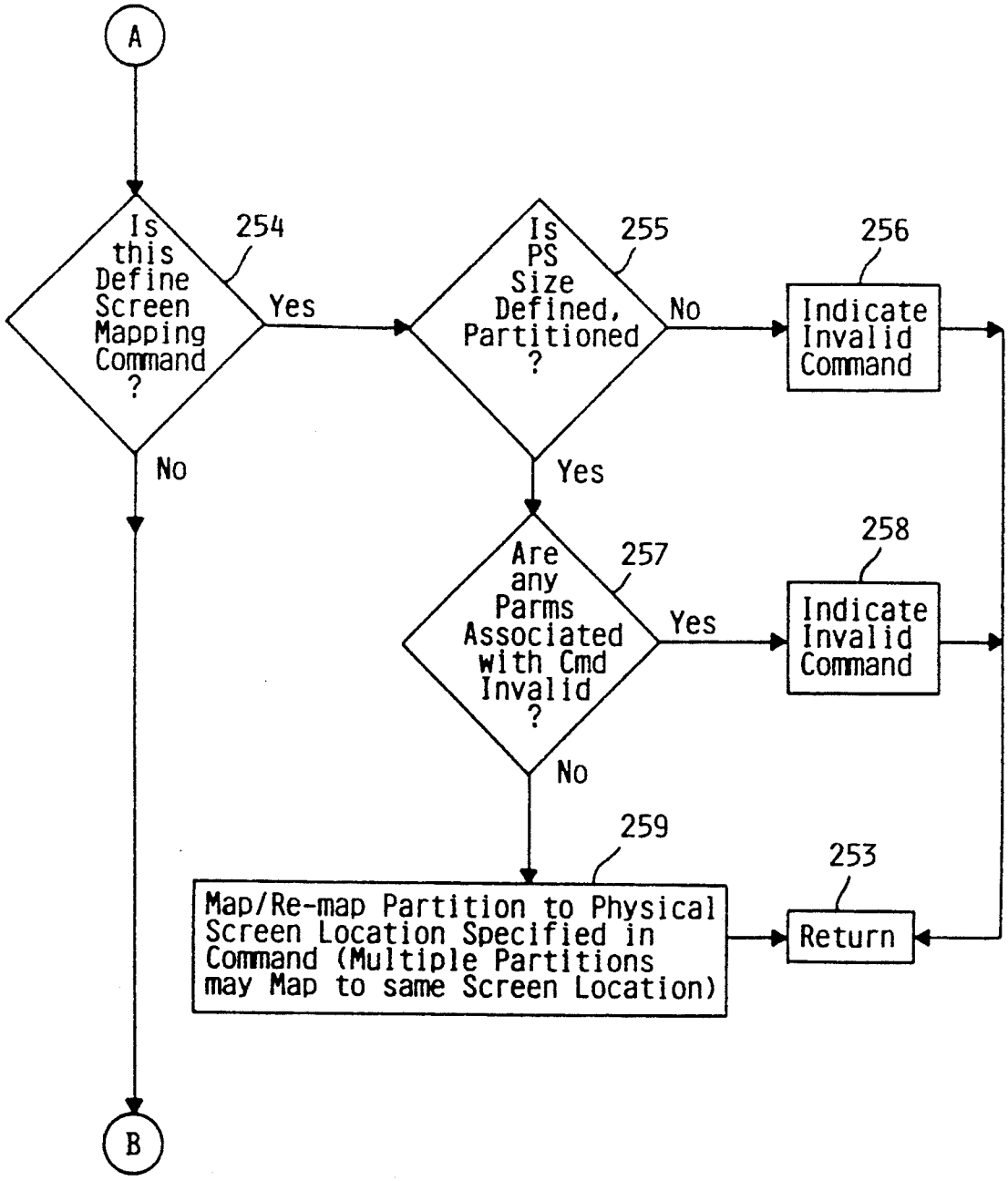
Figure 11C:
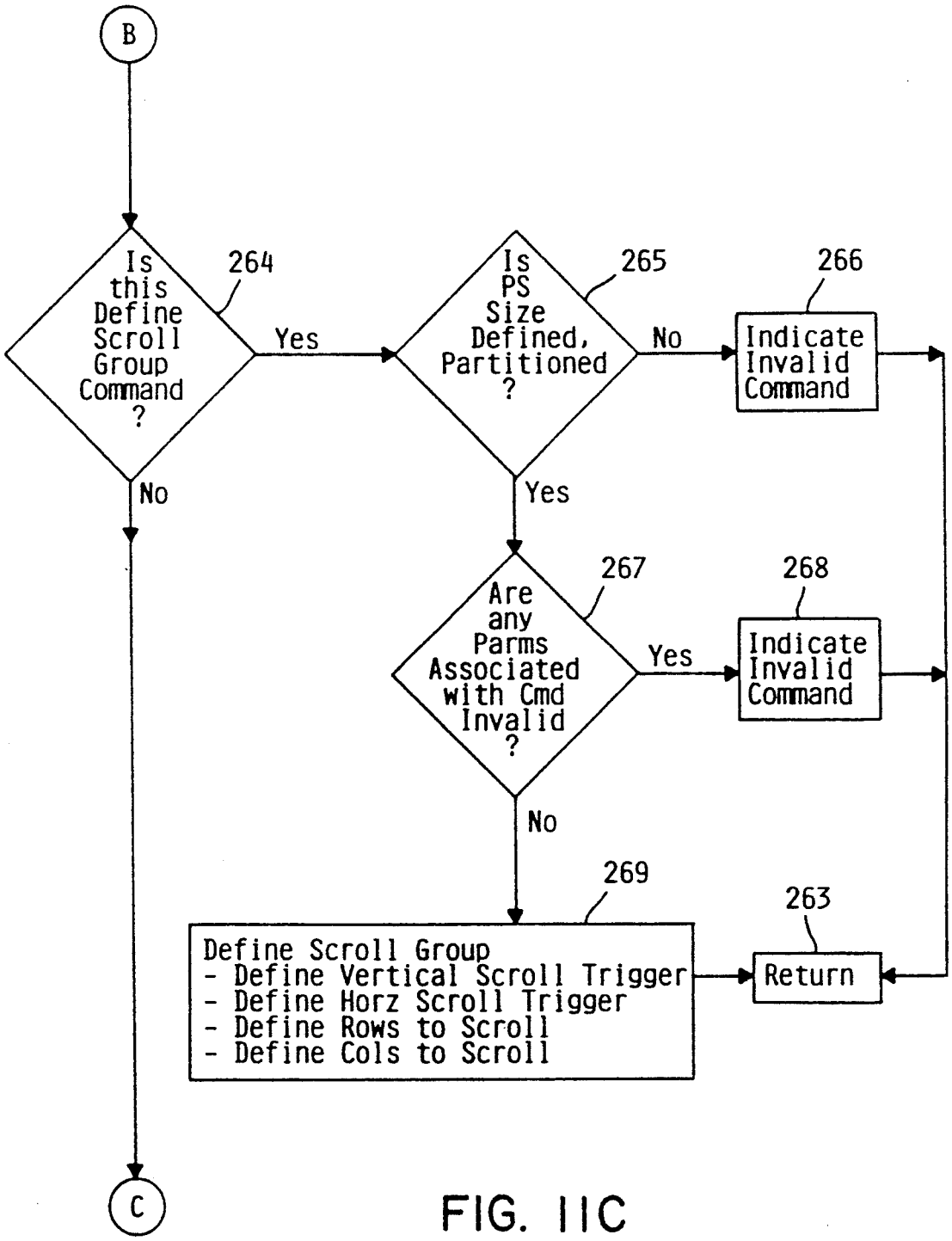
Figure 11D:
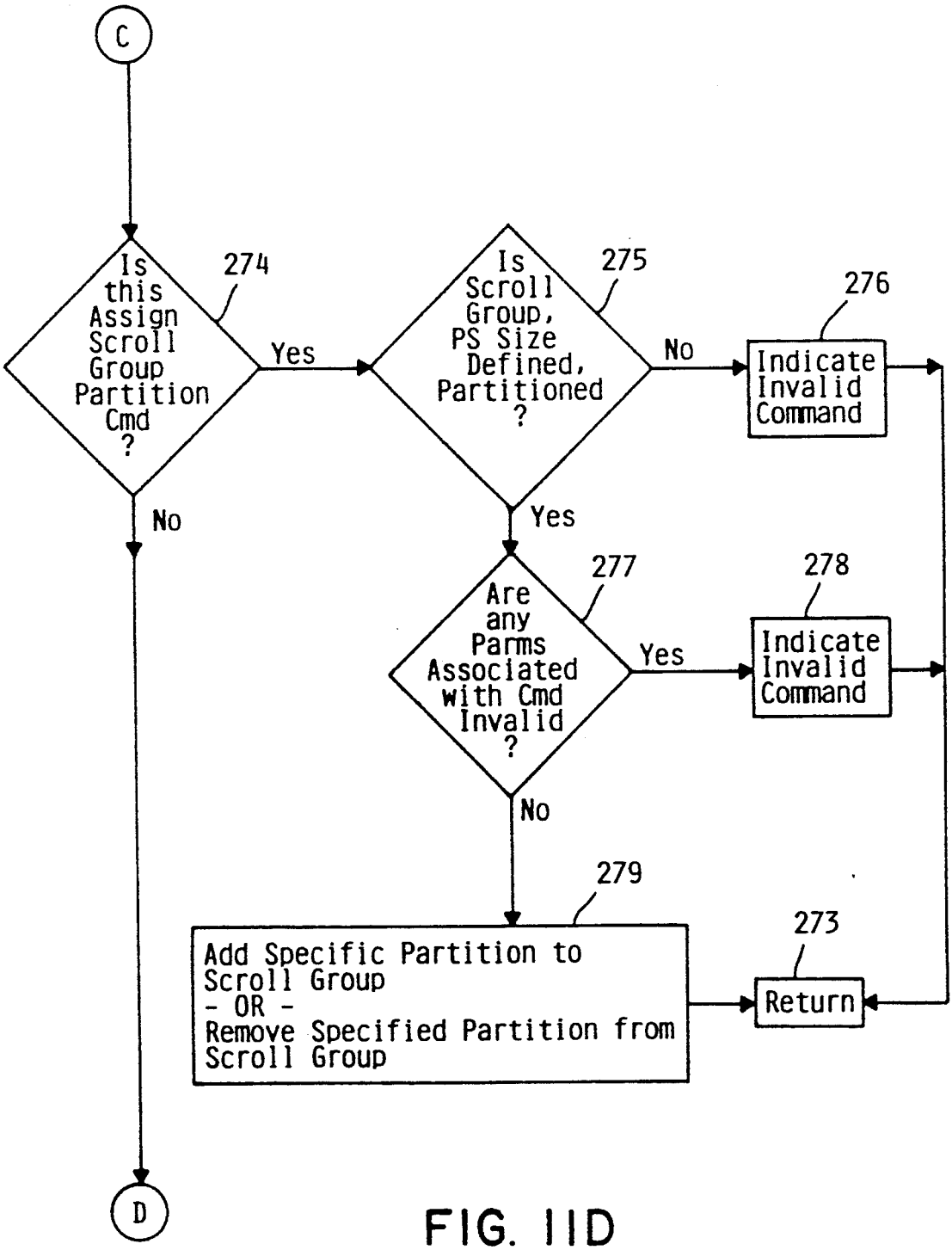
Figure 11E:
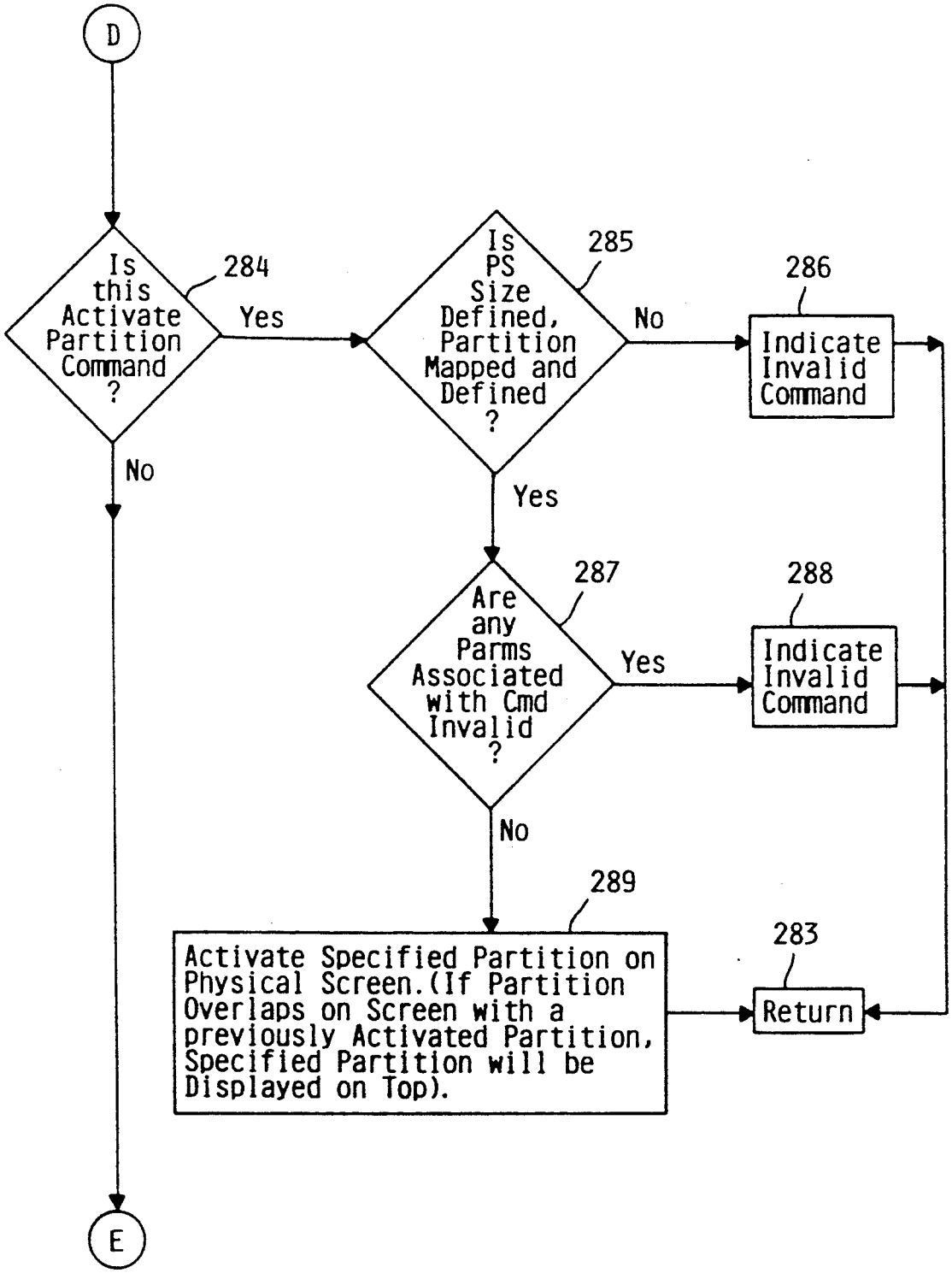
Figure 11F:
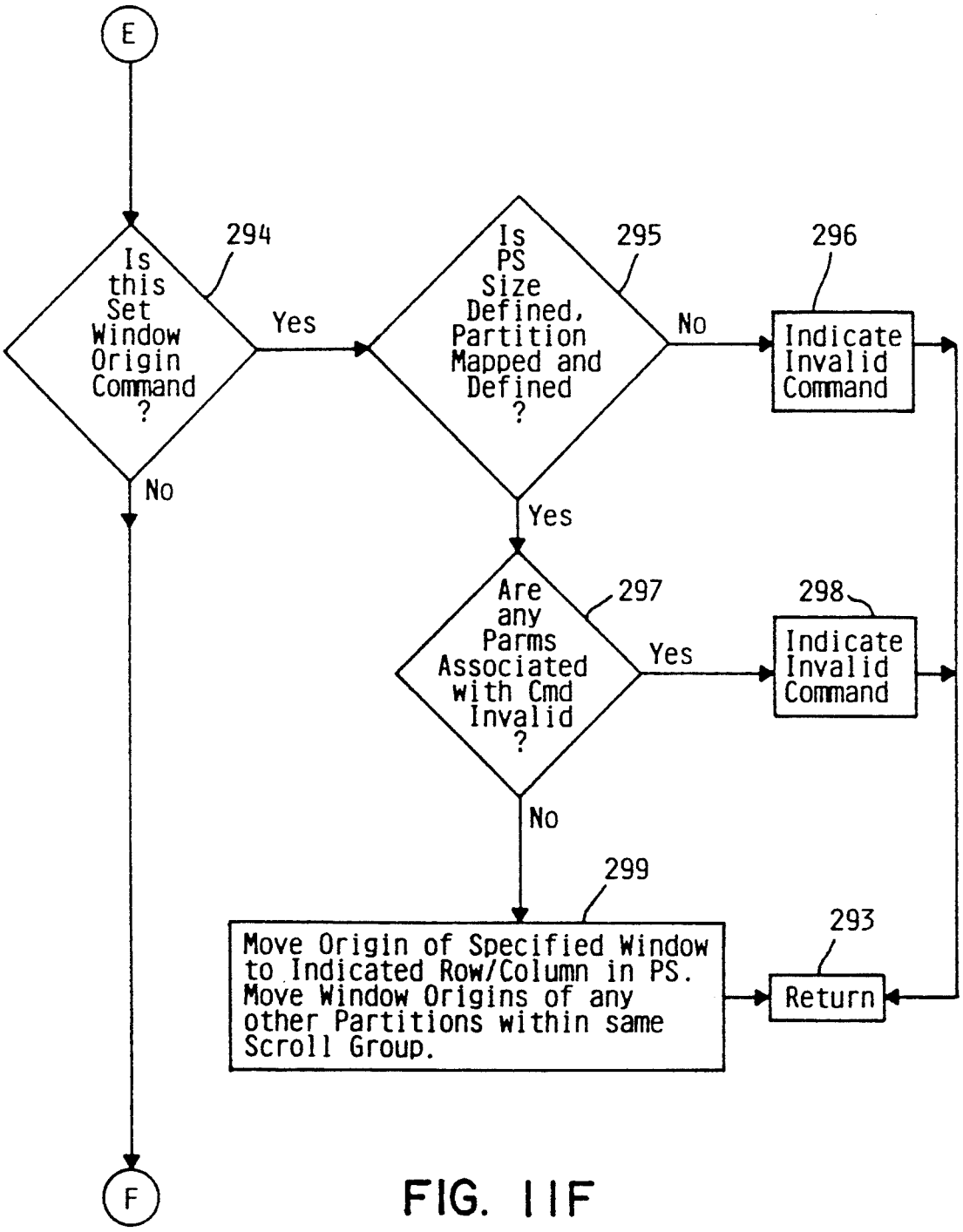
Figure 11G:
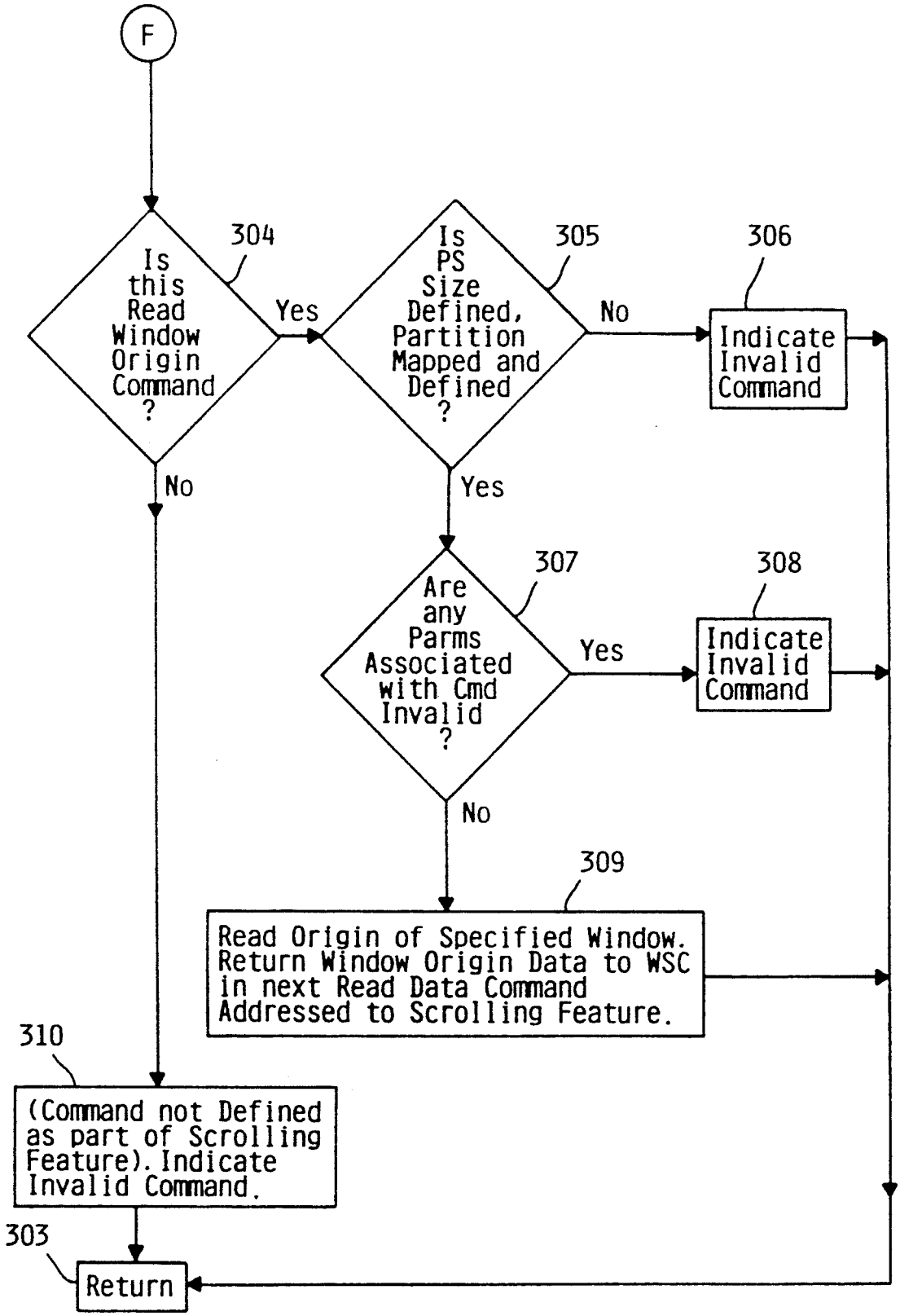

The subroutine then returns in block 283 to block 224 in FIG. 10.

If block 284 is answered negatively, block 294 checks to see if the Scrolling Feature Command is Set Partition Window Origin command 87 (FIG. 6). If so, block 295 makes sure that the size of presentation space buffer 50 has previously been defined and partitioned, the partition has been defined, and that the partition window has been mapped. If not, block 296 posts an error message and the subroutine returns in block 293 to block 224 in FIG. 10. If block 295 is answered affirmatively, block 297 checks to see if any parameters associated with the command are invalid. If so, block 298 posts an error message and the subroutine returns in block 293. If block 297 is answered negatively, block 299 moves the origin of the partition window in its associated partition in presentation space buffer 50, as has been discussed in conjunction with FIG. 6. In addition, the origins of any other partition windows having associated partitions in the same scroll group are also moved in block 299, as has been discussed. The subroutine then returns in block 293 to block 224 in FIG. 10.

If block 294 is answered negatively, block 304 checks to see if the Scrolling Feature Command is Read Partition Window Origin Command 88 (FIG. 6). If so, block 305 makes sure that the size of presentation space buffer 50 has previously been defined and partitioned, the partition has been defined, and that the partition window has been mapped. If not, block 306 posts an error message and the subroutine returns in block 303 to block 224 in FIG. 10. If block 305 is answered affirmatively, block 307 checks to see if any parameters associated with the command are invalid. If so, block 308 posts an error message and the subroutine returns in block 303. If block 307 is answered negatively, block 309 reads the origin of the partition window in its associated partition in presentation space buffer 50, as has been discussed in conjunction with FIG. 6, and returns this data to WSC 30. The subroutine then returns in block 303 to block 224 in FIG. 10.

If block 294 is answered negatively, this command is not a Scrolling Feature Command, and block 310 posts an error message. The subroutine then returns in block 303 to block 224 in FIG. 10.

Figure 12A:
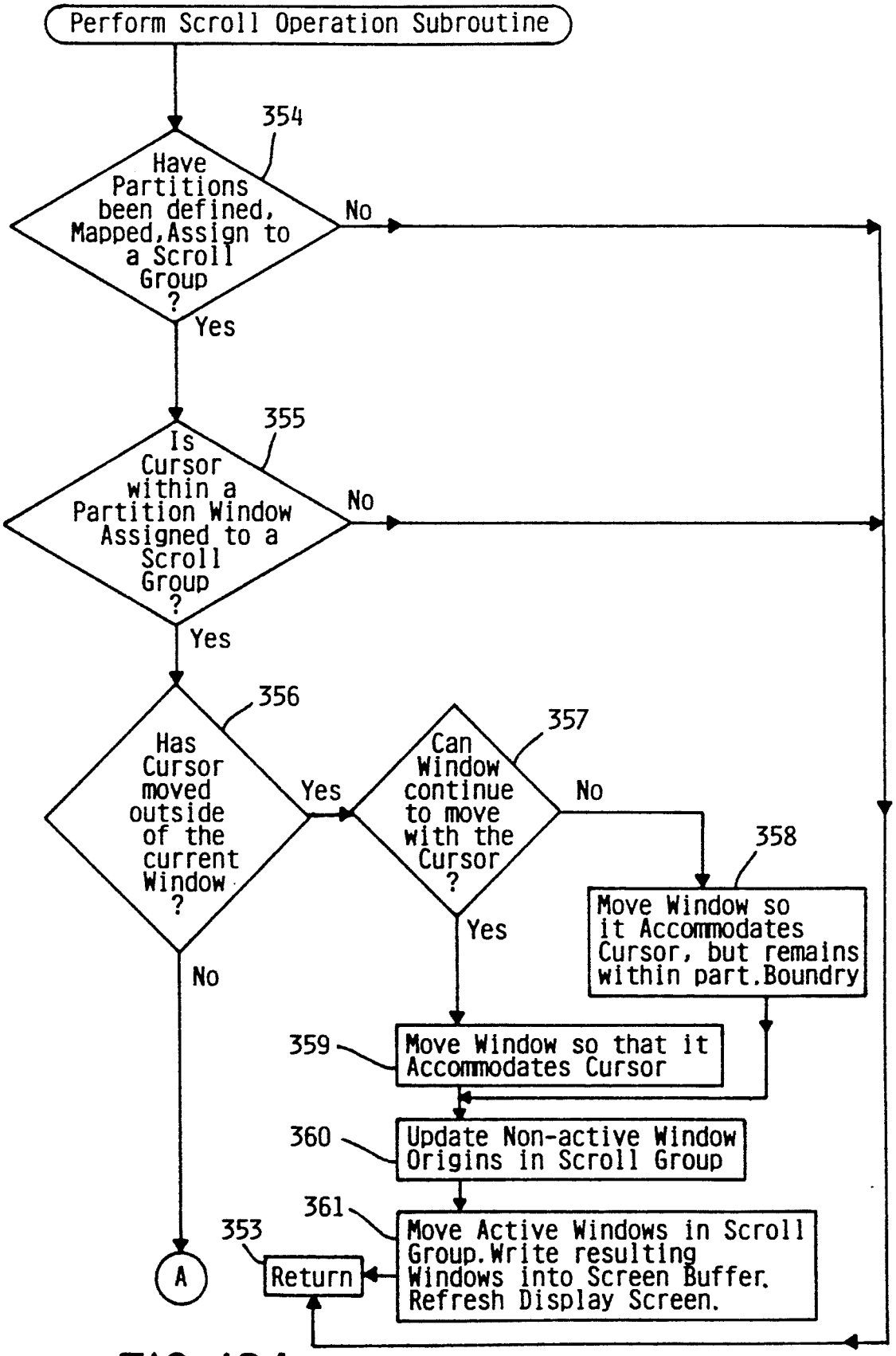
Figure 12B:
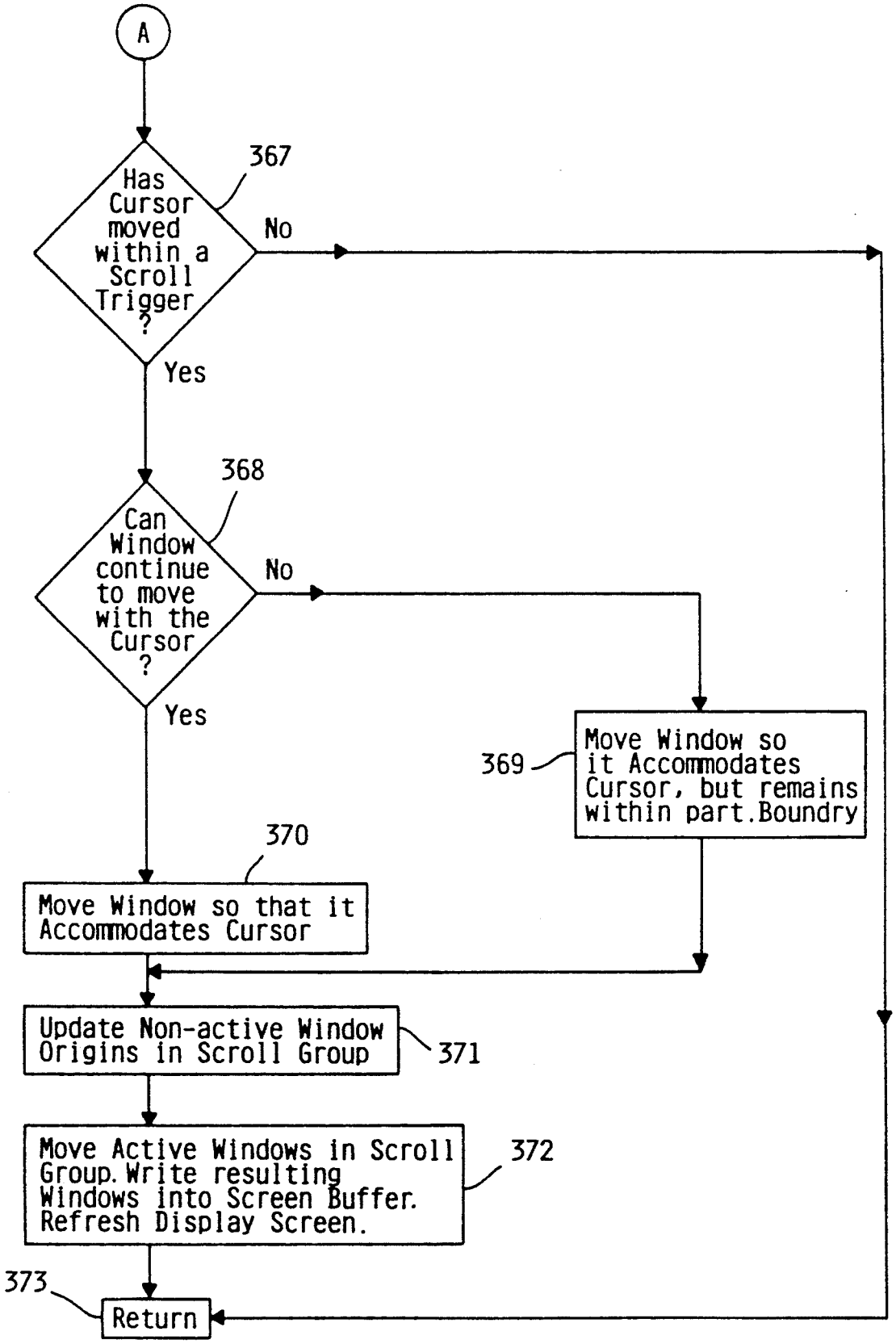

The Perform Scroll Operation subroutine of FIG. 12 will now be discussed. Block 354 checks to see if partitions have been defined, and assigned to a scroll group, and their associated partition windows mapped to screen buffer 70. If not, the subroutine returns in block 353 to block 209 in FIG. 9, where the cursor location is updated. If so, block 355 asks if the cursor is located within a partition window whose associated partition is assigned to a scroll group. As mentioned before, a partition window does not scroll unless its associated partition is assigned to a scroll group, so control goes to block 352 if block 355 is answered negatively.

If block 355 is answered affirmatively, block 356 asks if the cursor has moved outside of the current partition window without triggering a scroll trigger. This would happen if the user skipped around on the screen, such as tabbing, instead of inputting text or data one space at a time. If block 356 is answered yes, block 357 checks to see if the partition window can continue to move with the cursor without running into a partition boundary. If not, block 358 shifts the partition window over to the boundary of the partition. If so, block 359 shifts the partition window by the amount specified in the parameters of Define Scroll Group Command 84 (FIG. 6), as has been discussed. Block 360 then shifts any other partition windows having associated non-activated partitions in the same scroll group. As has been discussed, these partition windows are not written to screen buffer 70 until their associated partitions are activated. Block 361 shifts any other partition windows having associated activated partitions in the same scroll group, and writes all changed partition windows having associated activated partitions to screen buffer 70. The display screen is than refreshed with screen buffer 70. The subroutine returns in block 353 to block 209 in FIG. 9.

If the cursor has not moved outside the current partition window, block 356 is answered negatively, and block 367 checks to see if the cursor has moved within a scroll trigger as specified by the parameters of Define Scroll Group Command 84 (FIG. 6). If not, the subroutine returns in block 373 to block 209 in FIG. 9. If so, block 368 asks if the partition window can continue to move with the cursor without running into a partition boundary. If not, block 369 shifts the partition window over to the boundary of the partition. If so, block 370 shifts the partition window by the amount specified in the parameters of Define Scroll Group Command 84 (FIG. 6), as has been discussed. Block 371 then shifts any other partition windows having associated non-activated partitions in the same scroll group. As has been discussed, these partition windows are not written to screen buffer 70 until their associated partitions are activated. Block 372 shifts any other partition windows having associated activated partitions in the same scroll group, and writes all changed partition windows having associated activated partitions to screen buffer 70. The display screen is then refreshed with screen buffer 70. The subroutine returns in block 373 to block 209 in FIG. 9.

Note that the flowcharts of FIGS. 9–12 would be modified slightly in the first alternate embodiment, where display 40 is a standalone personal computer. For example, since commands are not received from a workstation controller but are handled internally, they would be placed directly into command buffer 43, so block 201 would not be necessary.

While this invention has been described with respect to preferred and alternate embodiments, it will be understood by those skilled in the art that various changes in detail may be made therein without departing from the spirit, scope and teaching of the invention. Accordingly, the herein disclosed is to be limited only as specified in the following claims.

What is claimed is:

1. A computer display having a display screen and a cursor, comprising:

a display processor;

a screen buffer, connected to said display processor;

a presentation space buffer, connected to said display processor, said presentation space buffer being larger than said screen buffer;

means for defining a first partition, a second partition, and a third partition in said presentation space buffer;

first mapping means for mapping a first partition window from said first partition to said screen buffer;

first activating means for activating said first partition;

first writing means for writing said first partition window to said screen buffer responsive to said first activating means;

second mapping means for mapping a second partition window from said second partition to said screen buffer;

second activating means for activating said second partition;

second writing means for writing said second partition window to said screen buffer responsive to said second activating means;

third mapping means for mapping a third partition window from said third partition to said screen buffer; and means for displaying said screen buffer on said display screen, wherein partition windows that have been mapped and activated are displayed, and wherein partition windows that have been mapped but not activated are not displayed.

2. The computer display of claim 1, further comprising:

third activating means for activating said third partition; and third writing means for writing said third partition window to said screen buffer responsive to said third activating means, wherein a portion of said screen buffer containing said first partition window is overlaid by said third partition window.

3. The computer display of claim 2, wherein said third activating means further comprises:

means for deactivating said third partition, wherein said third partition window is erased from said screen buffer and said overlaid portion of said first partition window is rewritten to said screen buffer, but without disturbing said mapping of said third partition to said screen buffer performed by said third mapping means.

4. A computer display having a display screen and a cursor, comprising:

a display processor;

a screen buffer, connected to said display processor;

a presentation space buffer, connected to said display processor, said presentation space buffer being larger than said screen buffer;

means for defining a first partition and a second partition in said presentation space buffer;

first mapping means for mapping a first partition window from said first partition to said screen buffer;

first activating means for activating said first partition;

first writing means for writing said first partition window to said screen buffer responsive to said first activating means;

second mapping means for mapping a second partition window from said second partition to said screen buffer; and means for displaying said screen buffer on said display screen, wherein only partition windows that have been mapped and activated are displayed, and wherein partition windows that have been mapped but not activated are not displayed.

5. The computer display of claim 4, further comprising:

second activating means for activating said second partition; and second writing means for writing said second partition window to said screen buffer responsive to said second activating means.

6. The computer display of claim 5, wherein a portion of said screen buffer containing said first partition window is overlaid by said second partition window.

7. The computer display of claim 5, wherein said second activating means further comprises:

means for deactivating said second partition, wherein said second partition window is erased from said screen buffer, but without disturbing said mapping of said second partition to said screen buffer performed by said second mapping means.

8. A method for activating and deactivating windows on a computer display having a display processor, a screen buffer, a presentation space buffer larger than said screen buffer, a display screen and a cursor, the method comprising the steps of:

defining a first partition and a second partition in said presentation space buffer;

mapping a first partition window from said first partition to said screen buffer;

activating said first partition;

writing said first partition window to said screen buffer responsive to said activating said first partition step;

mapping a second partition window from said send partition to said screen buffer; and displaying said screen buffer on said display screen, wherein only partition windows that have been mapped and activated are displayed, and wherein partition windows that have been mapped but not activated are not displayed.

9. The method of claim 8, further comprising the steps of:

activating said second partition; and writing said second partition to said screen buffer responsive to said activating said second partition step.

10. The method of claim 9, further comprising the step of:

deactivating said second partition, wherein said second partition window is erased from said screen buffer, but without disturbing said mapping of said second partition to said screen buffer performed by said mapping a second partition window step.

* * * * *